US009358561B2

(12) United States Patent
Johnson et al.

(10) Patent No.: US 9,358,561 B2
(45) Date of Patent: Jun. 7, 2016

(54) SPRAY HEAD ASSEMBLY WITH INTEGRATED AIR CAP/NOZZLE FOR A LIQUID SPRAY GUN

(75) Inventors: Erik J. Johnson, Cohasset, MN (US); Stephen C. P. Joseph, Woodbury, MN (US)

(73) Assignee: 3M INNOVATIVE PROPERTIES COMPANY, Saint Paul, MN (US)

( * ) Notice: Subject to any disclaimer, the term of this patent is extended or adjusted under 35 U.S.C. 154(b) by 38 days.

(21) Appl. No.: 14/234,764

(22) PCT Filed: Jul. 26, 2012

(86) PCT No.: PCT/US2012/048223

§ 371 (c)(1), (2), (4) Date: Mar. 24, 2014

(87) PCT Pub. No.: WO2013/016474

PCT Pub. Date: Jan. 31, 2013

(65) Prior Publication Data

US 2014/0246519 A1 Sep. 4, 2014

Related U.S. Application Data

(60) Provisional application No. 61/512,678, filed on Jul. 28, 2011.

(51) Int. Cl.
*B05B 7/08* (2006.01)
*B05B 7/24* (2006.01)
(Continued)

(52) U.S. Cl.
CPC ..... *B05B 7/0815* (2013.01); *B05B 7/066* (2013.01); *B05B 7/2435* (2013.01); *B05B 15/02* (2013.01); *B05B 7/063* (2013.01); *B05B 7/068* (2013.01); *B05B 7/2478* (2013.01)

(58) Field of Classification Search
CPC .... B05B 7/0807; B05B 7/0815; B05B 7/0861
See application file for complete search history.

(56) References Cited

U.S. PATENT DOCUMENTS 1,299,290 A 4/1919 Berg
1,539,536 A 5/1925 Bartling
(Continued)

FOREIGN PATENT DOCUMENTS

CN 1280885 1/2001
CN 2431971 5/2001
(Continued)

OTHER PUBLICATIONS

PCT International Search Report for PCT/US2012/048223, mailed Oct. 2, 2012.
(Continued)

*Primary Examiner* — Ryan Reis
(74) *Attorney, Agent, or Firm* — Aleksander Medved

(57) ABSTRACT

Integrated air cap/nozzles (40), spray head assemblies (20) including the integrated air cap/nozzles (40) and liquid spray guns that include the integrated air cap/nozzles (40) are described herein. The integrated air cap/nozzles (40) provide and define both the liquid nozzle openings (52) and the center air outlets (54) for the center air of the liquid spray guns and the spray head assemblies (20). The integrated air cap/nozzles (40) can be removably attached over a liquid nozzle port (32) formed in the spray head assembly (20) and/or on the spray gun platform (10) or body using any suitable attachment mechanism.

14 Claims, 19 Drawing Sheets

(51) Int. Cl.
*B05B 15/02* (2006.01)
*B05B 7/06* (2006.01)

(56) References Cited

U.S. PATENT DOCUMENTS 1,748,440 A 2/1930 Burdick
2,042,746 A * 6/1936 Tracy ..... 239/424
2,059,706 A 11/1936 Paasche
2,126,888 A 8/1938 Jenkins
2,362,946 A 11/1944 Stockdale
2,497,625 A 2/1950 Norwick
2,820,670 A 1/1958 Charlop
2,886,252 A 5/1959 Ehrensperger
2,904,262 A 9/1959 Peeps
2,991,940 A 7/1961 Dubler
3,062,453 A 11/1962 Matthews
3,157,360 A 11/1964 Heard
3,168,250 A 2/1965 Paasche
3,236,459 A 2/1966 McRitchie
3,270,920 A 9/1966 Nessler
3,515,354 A 6/1970 Presson
3,581,998 A 6/1971 Roche
3,623,669 A 11/1971 Woods
3,633,828 A 1/1972 Larson
3,876,150 A 4/1975 Dwyer
3,942,680 A 3/1976 Seeley
4,160,525 A 7/1979 Wagner
4,392,617 A 7/1983 Bakos
4,403,738 A 9/1983 Kern
4,513,913 A 4/1985 Smith
4,529,126 A 7/1985 Ives
4,537,357 A 8/1985 Culbertson
4,562,965 A 1/1986 Ihmels
4,615,485 A 10/1986 Larson
4,657,184 A 4/1987 Weinstein
4,660,774 A 4/1987 Kwok
4,712,739 A 12/1987 Bihn
4,760,962 A 8/1988 Wheeler
4,811,904 A 3/1989 Ihmels
4,815,666 A 3/1989 Gacka
4,817,872 A 4/1989 Mattson
4,830,281 A 5/1989 Calder
4,925,101 A 5/1990 Konieczynski
4,971,251 A 11/1990 Dobrick
4,993,642 A 2/1991 Hufgard
5,022,590 A 6/1991 Buschor
5,110,011 A 5/1992 Laska
5,119,992 A 6/1992 Grime
5,152,460 A 10/1992 Barty
5,178,330 A * 1/1993 Rodgers ..... 239/300
5,242,115 A 9/1993 Brown
5,280,853 A 1/1994 Perret
5,322,221 A 6/1994 Anderson
5,332,156 A 7/1994 Wheeler
5,395,046 A 3/1995 Knobbe
5,454,517 A 10/1995 Naemura
5,474,450 A 12/1995 Chronister
5,582,350 A 12/1996 Kosmyna
5,607,108 A 3/1997 Garlick
5,609,302 A * 3/1997 Smith ..... 239/526
5,613,637 A 3/1997 Schmon
5,711,421 A 1/1998 Guo
5,765,753 A 6/1998 Kieffer
5,875,971 A 3/1999 Morck
5,961,050 A 10/1999 Kitajima
5,979,797 A 11/1999 Castellano
6,012,651 A 1/2000 Spitznagel
6,019,294 A 2/2000 Anderson
6,056,213 A 5/2000 Ruta
6,068,203 A 5/2000 DeYoung
6,085,996 A 7/2000 Culbertson
D429,794 S 8/2000 Beaver
6,098,902 A 8/2000 Culbertson
6,105,881 A 8/2000 Kitajima
6,254,015 B1 7/2001 Abplanalp
6,345,776 B1 2/2002 Hurray
6,375,096 B1 4/2002 Rashidi
6,425,536 B2 7/2002 Namura
6,450,422 B1 9/2002 Maggio
6,460,787 B1 10/2002 Hartle
6,471,144 B1 10/2002 Huang
6,494,387 B1 12/2002 Kaneko
6,502,763 B1 1/2003 McCann
6,536,687 B1 3/2003 Navis
6,543,705 B1 4/2003 Liao
6,601,782 B1 8/2003 Sandholm
6,685,106 B1 * 2/2004 van der Steur ..... 239/296
6,702,198 B2 3/2004 Tam
6,719,212 B1 4/2004 Leisi
6,749,132 B2 6/2004 Pettit
6,793,155 B2 9/2004 Huang
6,805,306 B1 10/2004 Huang
6,808,122 B2 10/2004 Mitcheli
6,820,824 B1 11/2004 Joseph
6,854,667 B2 2/2005 Ulrich
6,860,438 B1 3/2005 Huang
6,874,702 B2 4/2005 Turnbull
6,935,577 B2 8/2005 Strong
6,953,155 B2 10/2005 Joseph
6,971,590 B2 12/2005 Blette
7,032,839 B2 4/2006 Blette
7,083,119 B2 8/2006 Bouic
7,097,118 B1 8/2006 Huang
7,165,732 B2 1/2007 Kosmyna
D538,886 S 3/2007 Huang
7,201,336 B2 4/2007 Blette
D542,375 S 5/2007 Blette
D542,376 S 5/2007 Blette
7,246,759 B2 7/2007 Turnbull
D548,816 S 8/2007 Schmon
7,328,855 B2 2/2008 Chatron
RE40,433 E 7/2008 Schmon
D572,343 S 7/2008 Huang
7,484,676 B2 2/2009 Joseph
7,513,443 B2 4/2009 Escoto, Jr.
7,694,896 B2 4/2010 Turnbull
D616,527 S 5/2010 Anderson
7,712,682 B2 5/2010 Joseph
7,757,972 B2 7/2010 Kosmyna
7,789,324 B2 9/2010 Bouic
7,789,327 B2 9/2010 Micheli
7,798,061 B2 9/2010 Dilou
7,891,588 B2 2/2011 Jones
7,922,107 B2 4/2011 Fox
7,971,806 B2 7/2011 Johnson
8,066,205 B2 11/2011 Bass
8,297,536 B2 10/2012 Ruda
8,313,047 B2 11/2012 Micheli
8,360,345 B2 1/2013 Micheli
8,500,043 B2 8/2013 Heigl
8,590,809 B2 11/2013 Escoto, Jr.
2002/0104898 A1 8/2002 Bonnique
2003/0071144 A1 4/2003 Naemura
2003/0111553 A1 6/2003 Hunter
2003/0173419 A1 9/2003 Huang
2004/0089742 A1 5/2004 Antonucci
2004/0140373 A1 7/2004 Joseph
2004/0195401 A1 10/2004 Strong
2004/0245673 A1 12/2004 Allsop
2004/0256484 A1 12/2004 Joseph
2004/0256493 A1 12/2004 Turnbull
2005/0016448 A1 1/2005 Dilou
2005/0035220 A1 2/2005 Brown
2005/0045741 A1 3/2005 Brown
2005/0087128 A1 4/2005 Jakupovic
2005/0145724 A1 7/2005 Blette
2005/0173561 A1 8/2005 Cotter
2006/0000927 A1 1/2006 Ruda
2006/0065761 A1 3/2006 Joseph
2006/0097070 A1 5/2006 Huffman
2006/0102550 A1 5/2006 Joseph
2006/0175433 A1 8/2006 Escoto, Jr.
2007/0102535 A1 5/2007 Carey
2007/0262169 A1 11/2007 Wang

(56) References Cited

U.S. PATENT DOCUMENTS

| | | | |
|---|---|---|---|
| 2007/0262172 | A1 | 11/2007 | Huffman |
| 2008/0078849 | A1 | 4/2008 | Fox |
| 2008/0093479 | A1 | 4/2008 | Delbridge |
| 2008/0272213 | A1 | 11/2008 | Ting |
| 2009/0026290 | A1 | 1/2009 | Fox |
| 2009/0121048 | A1 | 5/2009 | Noshima |
| 2009/0302133 | A1 | 12/2009 | Micheli |
| 2010/0108783 | A1 | 5/2010 | Joseph |
| 2010/0123024 | A1 | 5/2010 | Gohring |
| 2010/0133358 | A1 | 6/2010 | Goehring |
| 2010/0187333 | A1 | 7/2010 | Escoto, Jr. |
| 2010/0282868 | A1 | 11/2010 | Heigl |
| 2011/0168811 | A1 | 7/2011 | Fox |
| 2013/0327850 | A1 | 12/2013 | Joseph |
| 2014/0014741 | A1 | 1/2014 | Escoto |
| 2015/0028131 | A1 | 1/2015 | Joseph |

FOREIGN PATENT DOCUMENTS

| | | |
|---|---|---|
| CN | 1827231 | 9/2006 |
| DE | 3815327 | 11/1989 |
| DE | 4027421 | 3/1992 |
| DE | 4302911 | 8/1993 |
| DE | 19503495 | 8/1996 |
| DE | 19605227 | 8/1997 |
| DE | 10315426 | 6/2004 |
| DE | 60005536 | 7/2004 |
| DE | 102004027789 | 2/2005 |
| DE | 102004044475 | 12/2005 |
| DE | 102007012989 | 10/2007 |
| DE | 202011050102 | 9/2011 |
| EP | 279992 | 8/1988 |
| EP | 509367 | 10/1992 |
| EP | 0492333 | 3/1995 |
| EP | 0885658 | 12/1998 |
| EP | 1340550 | 9/2003 |
| EP | 1479447 | 11/2004 |
| EP | 1554051 | 4/2006 |
| EP | 1682231 | 7/2006 |
| EP | 1699565 | 6/2008 |
| EP | 1964616 | 9/2008 |
| EP | 2108460 | 10/2009 |
| EP | 2386360 | 11/2011 |
| EP | 2486985 | 8/2012 |
| GB | 425382 | 9/1934 |
| GB | 829370 | 3/1960 |
| GB | 1231041 | 5/1971 |
| GB | 1293341 | 10/1972 |
| GB | 1338099 | 11/1973 |
| JP | 63-39448 | 3/1988 |
| JP | H07-265751 | 10/1995 |
| JP | H1028906 | 2/1998 |
| JP | 2003112086 | 4/2003 |
| JP | 2005211699 | 8/2005 |
| KR | 10-0435685 | 6/2004 |
| KR | 20-0428831 | 10/2006 |
| NL | 1024774 | 3/2004 |
| RU | 2014906 | 6/1994 |
| RU | 2060383 | 5/1996 |
| SU | 172206 | 1/1965 |
| SU | 1111832 | 9/1984 |
| SU | 1423175 | 9/1988 |
| SU | 1613181 | 12/1990 |
| WO | WO 03/051524 | 6/2003 |
| WO | WO 2004/037432 | 5/2004 |
| WO | WO 2004/037433 | 5/2004 |
| WO | WO 2004/087332 | 10/2004 |
| WO | WO 2005/049145 | 6/2005 |
| WO | WO 2005/063361 | 7/2005 |
| WO | WO 2006/053229 | 5/2006 |
| WO | WO 2006/098623 | 9/2006 |
| WO | WO 2006/107935 | 10/2006 |
| WO | WO 2007/056589 | 5/2007 |
| WO | WO 2007/104967 | 9/2007 |
| WO | WO 2007/139639 | 12/2007 |
| WO | WO 2008/016557 | 2/2008 |
| WO | WO 2013/016474 | 1/2013 |

OTHER PUBLICATIONS

Ihmels, Manfred, Ihmels Article—SATA, Feb. 15, 1989, 2 pages.

* cited by examiner

SPRAY HEAD ASSEMBLY WITH INTEGRATED AIR CAP/NOZZLE FOR A LIQUID SPRAY GUN

CROSS REFERENCE TO RELATED APPLICATIONS

This application is a national stage filing under 35 U.S.C. 371 of PCT/US2012/048223, filed Jul. 26, 2012, which claims priority to U.S. Provisional Application No. 61/512,678, filed Jul. 28, 2011, the disclosures of which are incorporated by reference in their entireties herein.

Spray head assemblies incorporating an integrated air cap/nozzle, and liquid spray guns including the integrated air cap/nozzles are described herein.

Spray guns are widely used in vehicle body repair shops when spraying a vehicle with liquid coating media, e.g., primer, paint and/or clearcoat. Typically the spray gun includes a body and an integral handle, with a compressed air inlet, air passageways, a liquid nozzle assembly, and a trigger mechanism for releasing the liquid to a nozzle for discharge of the liquid in the form of an atomized spray. During use, the coating media may accumulate on the exterior and interior surfaces of the gun. Unless thoroughly cleaned between operations, dried coating media may accumulate, thereby adversely affecting spraying performance, and possibly contaminating subsequent applications.

Spray head assemblies used with liquid spray guns typically include an air cap and a nozzle tip, both of which are often removable from the liquid spray gun for cleaning and/or to change the spraying properties by, e.g., using an air cap and/or nozzle tip having different characteristics. Typically, however, the air cap of a spray head assembly must be removed with the entire spray head assembly or before the nozzle tip can be removed. That requirement can complicate changes in the nozzle tip to obtain different spray characteristics and/or changing or cleaning clogged nozzle tips, etc., and may, in some instances, require replacement of the entire spray head assembly when only the nozzle tip needs to be changed.

For example, in some designs in which the air cap/nozzle are constructed of molded, solvent resistant plastic, removal of the air cap from the liquid spray gun body and/or the spray head assembly may damage the air cap, making its re-use impossible. In other instances, even the potential damage that could be caused by removal of the air cap may result in its replacement in those instances where the cost of potential damage to the air cap far exceeds the cost of merely replacing it along with the nozzle as a precautionary measure.

SUMMARY

Spray head assemblies including integrated air cap/nozzles, and liquid spray guns that include the integrated air cap/nozzles are described herein. In some embodiments, the integrated air cap/nozzles may be constructed of a molded plastic and include features designed to deliver both air and the liquid to be sprayed in a manner that results in a spray coating.

In some implementations of the present disclosure, integrated air cap/nozzles described herein provide and define both the liquid nozzle openings and the center air outlets for the center air of the spray head assemblies described herein. The integrated air cap/nozzles are removably attached over a liquid nozzle port formed in the spray head assembly and/or on the spray gun platform using any suitable attachment mechanism. In addition, the removable integrated air cap/nozzles are designed to be removed while the portion of the spray head assembly remains assembled and attached to the liquid spray gun platform. As a result, the removable integrated air cap/nozzles of the spray head assemblies described herein can preferably be removed for cleaning and/or replacement without requiring removal or detachment of other components from the barrel or spray gun platform.

In one implementation, the present disclosure is directed to a spray head assembly for attachment to a liquid spray gun platform, which includes a barrel comprising a liquid supply passage extending from an inlet end in the barrel to a nozzle port on the barrel. The spray head assembly further includes an integrated air cap/nozzle capable of being removably attached to the barrel. The integrated air cap/nozzle includes a front wall comprising a center air outlet; a nozzle body attached to the integrated air cap/nozzle, the nozzle body comprising a nozzle body inlet end and a nozzle outlet end; a liquid nozzle opening formed in the nozzle outlet end of the nozzle body and a nozzle passage extending through the nozzle body from the nozzle body inlet to the liquid nozzle opening. The nozzle body inlet is positioned over the nozzle port on the barrel when the integrated air cap/nozzle is attached to the barrel such that liquid entering the nozzle passage through the nozzle port exits from the liquid nozzle opening after passing through the nozzle passage. When attached to the barrel, the integrated air cap/nozzle defines a center air chamber that extends from a barrel inlet to the center air outlet in the integrated air cap/nozzle, wherein air entering the barrel inlet passes through the center air chamber before passing out of the center air outlet during use of the spray head assembly. The removal of the integrated air cap/nozzle from the barrel removes the nozzle body from the nozzle port of the barrel.

In another aspect, the present disclosure is directed to a spray head assembly for attachment to a liquid spray gun platform, which includes a barrel adaptor configured for attachment to a liquid spray gun platform, wherein the barrel adaptor comprises a nozzle port. The spray head assembly further includes an integrated air cap/nozzle removably attached to the barrel adaptor. The integrated air cap/nozzle includes a front wall comprising a center air outlet; a nozzle body attached to the integrated air cap/nozzle, the nozzle body comprising an inlet end and a nozzle outlet end; a liquid nozzle opening formed in the nozzle outlet end of the nozzle body; a nozzle body inlet formed in the nozzle body; and a nozzle passage extending through the nozzle body from the nozzle body inlet to the liquid nozzle opening. The nozzle body inlet is positioned over the nozzle port on the barrel when the integrated air cap/nozzle is attached to the barrel adaptor such that liquid entering the nozzle passage through the nozzle port exits from the nozzle passage through the liquid nozzle opening. When attached to the barrel adaptor, the integrated air cap/nozzle defines a center air chamber that extends from the barrel plate to the center air outlet in the integrated air cap/nozzle, wherein air enters the center air chamber through the center air aperture in the barrel plate before passing out of the center air outlet during use of the spray head assembly. The removal of the integrated air cap/nozzle from the barrel adaptor removes the nozzle body from the nozzle port of the barrel adaptor.

In yet another aspect, the present disclosure is directed to an integrated air cap/nozzle for a liquid spray gun. The integrated air cap/nozzle has a cap body comprising a nozzle body having a liquid nozzle opening through which liquid exits during operation of the liquid spray gun and a center air outlet through which center air discharges when a liquid is sprayed through the liquid nozzle opening. The liquid nozzle opening and the center air outlet are formed in the cap body.

In yet another aspect, the present disclosure is directed to a liquid spray gun including a liquid spray gun comprising a nozzle port and a removable integrated air cap/nozzle. The removable integrated air cap/nozzle includes a nozzle body and is removably attached to the liquid spray gun such that the nozzle body of the integrated air cap/nozzle is positioned over the nozzle port when the integrated air cap/nozzle is attached to the liquid spray gun. The integrated air cap/nozzle comprises a liquid nozzle opening through which liquid exits during operation of the liquid spray gun and a center air outlet through which center air discharges when a liquid is sprayed through the integrated air cap/nozzle. The liquid nozzle opening and the center air outlet are formed in the removable integrated air cap/nozzle.

The present disclosure includes, but is not limited to, the following exemplary embodiments:

Embodiment 1. A spray head assembly for attachment to a liquid spray gun platform, wherein the spray head assembly comprises:

a barrel comprising a liquid supply passage extending from an inlet end in the barrel to a nozzle port on the barrel;

an integrated air cap/nozzle capable of being removably attached to the barrel, wherein the integrated air cap/nozzle comprises:

a front wall comprising a center air outlet;

a nozzle body attached to the integrated air cap/nozzle, the nozzle body comprising a nozzle body inlet end and a nozzle outlet end;

a liquid nozzle opening formed in the nozzle outlet end of the nozzle body and a nozzle passage extending through the nozzle body from the nozzle body inlet to the liquid nozzle opening;

wherein the nozzle body inlet is positioned over the nozzle port on the barrel when the integrated air cap/nozzle is attached to the barrel such that liquid entering the nozzle passage through the nozzle port exits from the liquid nozzle opening after passing through the nozzle passage;

wherein, when attached to the barrel, the integrated air cap/nozzle defines a center air chamber that extends from a barrel inlet to the center air outlet in the integrated air cap/nozzle, wherein air entering the barrel inlet passes through the center air chamber before passing out of the center air outlet during use of the spray head assembly;

wherein removal of the integrated air cap/nozzle from the barrel removes the nozzle body from the nozzle port of the barrel.

Embodiment 2. A spray head assembly according to Embodiment 1, further comprising a structure for removably attaching the integrated air cap/nozzle to the barrel, which includes one or more features disposed on a surface of the integrated air cap/nozzle and one or more mating structures disposed on a surface of the barrel.

Embodiment 3. A spray head assembly according to any one of Embodiment 1, further comprising a structure for removably attaching the integrated air cap/nozzle to the barrel, the removable structure being spaced apart from the nozzle body and the nozzle port.

Embodiment 4. A spray head assembly for attachment to a liquid spray gun platform, wherein the spray head assembly comprises:

a barrel adaptor configured for attachment to a liquid spray gun platform, wherein the barrel adaptor comprises a nozzle port;

an integrated air cap/nozzle removably attached to the barrel adaptor, wherein the integrated air cap/nozzle comprises:

a front wall comprising a center air outlet;

a nozzle body attached to the integrated air cap/nozzle, the nozzle body comprising an inlet end and a nozzle outlet end;

a liquid nozzle opening formed in the nozzle outlet end of the nozzle body;

a nozzle body inlet formed in the nozzle body;

a nozzle passage extending through the nozzle body from the nozzle body inlet to the liquid nozzle opening;

wherein the nozzle body inlet is positioned over the nozzle port on the barrel when the integrated air cap/nozzle is attached to the barrel adaptor such that liquid entering the nozzle passage through the nozzle port exits from the nozzle passage through the liquid nozzle opening;

wherein, when attached to the barrel adaptor, the integrated air cap/nozzle defines a center air chamber that extends from the barrel plate to the center air outlet in the integrated air cap/nozzle, wherein air enters the center air chamber through the center air aperture in the barrel plate before passing out of the center air outlet during use of the spray head assembly;

wherein removal of the integrated air cap/nozzle from the barrel adaptor removes the nozzle body from the nozzle port of the barrel adaptor.

Embodiment 5. A spray head assembly according to Embodiment 4, wherein the integrated air cap/nozzle is attached to the liquid spray gun platform over the barrel adaptor by a retaining ring.

Embodiment 6. A spray head assembly according to any one of Embodiments 1-5, wherein the front wall further comprises a nozzle aperture and wherein the nozzle outlet end is located in the nozzle aperture, and wherein the nozzle aperture and the nozzle outlet end define a gap therebetween, and further wherein the gap forms a center air outlet between the nozzle aperture and the nozzle outlet end.

Embodiment 7. A spray head assembly according to any one of Embodiments 1-6, wherein the nozzle body is attached to the front wall of the integrated air cap/nozzle by one or more support members extending from the nozzle body to the front wall.

Embodiment 8. A spray head assembly according to any one of Embodiments 1-7, wherein the gap formed by the nozzle outlet end and the nozzle aperture comprises an annular gap.

Embodiment 9. A spray head assembly according to any one of Embodiments 1-8, wherein the nozzle body comprises a nozzle sealing structure proximate the nozzle body inlet, wherein the nozzle sealing structure forms a liquid tight seal with the nozzle port on the barrel when the integrated air cap/nozzle is attached to the barrel.

Embodiment 10. A spray head assembly according to any one of Embodiments 1-9, wherein the nozzle body and the front wall are formed as an integral, one-piece component.

Embodiment 11. A spray head assembly according to any one of Embodiments 1-10, wherein the nozzle outlet end, the liquid nozzle opening, and the center air outlet are shaped to direct air under greater than atmospheric pressure against liquid flowing out of the liquid nozzle opening.

Embodiment 12. A spray head assembly according to any one of Embodiments 1-11, wherein the integrated air cap/nozzle comprises two air horns, and wherein the integrated air cap/nozzle, when attached to the barrel, also defines a fan control air chamber that extends from an inlet end of a fan air barrel passage formed in the barrel to apertures located on air horns projecting past the nozzle aperture, wherein the apertures in the air horns are located on opposite sides of an axis extending through the liquid nozzle opening such that air flowing out of the fan control air chamber through the apertures on the air horns under greater than atmospheric pressure flows against opposite sides of a stream of liquid exiting the liquid nozzle opening.

Embodiment 13. A spray head assembly according to any one of Embodiments 1-12, wherein the nozzle body comprises one or more frusto-conically shaped sections, one or more cylindrically shaped sections or a combination thereof.

Embodiment 14. A spray head assembly according to any one of Embodiments 1-13, wherein the nozzle port comprises a structure that is projecting, recessed or level with respect to a front wall of the barrel.

Embodiment 15. A spray head assembly according to any one of Embodiments 1-14, wherein the nozzle port comprises one or more frusto-conically shaped sections, one or more cylindrically shaped sections or a combination thereof.

Embodiment 16. A spray head assembly according to any one of Embodiments 1-12, wherein at least a portion of the nozzle port is received within the nozzle body.

Embodiment 17. A spray head assembly according to any one of Embodiments 1-12, wherein at least a portion of the nozzle body is received within the nozzle port.

Embodiment 18. A kit comprising a spray head assembly as recited in any one of Embodiments 1-17, wherein the kit further comprises a plurality of the integrated air cap/nozzles having different configurations.

Embodiment 19. An integrated air cap/nozzle for a liquid spray gun, wherein the integrated air cap/nozzle comprises:

a cap body comprising:

a nozzle body comprising a liquid nozzle opening through which liquid exits during operation of the liquid spray gun; and a center air outlet through which center air discharges when a liquid is sprayed through the liquid nozzle opening;

wherein the liquid nozzle opening and the center air outlet are formed in the cap body.

Embodiment 20. An integrated air cap/nozzle according to Embodiment 19, wherein the integrated air cap/nozzle is removably attached to a liquid spray gun.

Embodiment 21. An integrated air cap/nozzle according to Embodiment 19, wherein the cap body further comprises a liquid port in fluid communication with the nozzle body.

Embodiment 22. An integrated air cap/nozzle according to any one of Embodiments 19-21, wherein the front wall further comprises a nozzle aperture and wherein the nozzle outlet end is located in the nozzle aperture, and wherein the nozzle aperture and the nozzle outlet end define a gap therebetween, and further wherein the gap forms a center air outlet between the nozzle aperture and the nozzle outlet end.

Embodiment 23. An integrated air cap/nozzle according to any one of Embodiments 19-21, wherein the nozzle body is attached to the front wall of the integrated air cap/nozzle by one or more support members extending from the nozzle body to the front wall.

Embodiment 24. An integrated air cap/nozzle according to any one of Embodiments 19-23, wherein the gap formed by the nozzle outlet end and the nozzle aperture comprises an annular gap.

Embodiment 25. An integrated air cap/nozzle according to any one of Embodiments 19-23, wherein the nozzle body comprises a nozzle sealing structure proximate the nozzle body inlet, wherein the nozzle sealing structure forms a liquid tight seal with the nozzle port on the barrel when the integrated air cap/nozzle is attached to the barrel.

Embodiment 26. An integrated air cap/nozzle according to any one of Embodiments 19-25, wherein the nozzle body and the front wall are formed as an integral, one-piece component.

Embodiment 27. An integrated air cap/nozzle according to any one of Embodiments 19-26, wherein the nozzle outlet end, the liquid nozzle opening, and the center air outlet are shaped to direct air under greater than atmospheric pressure against liquid flowing out of the liquid nozzle opening.

Embodiment 28. An integrated air cap/nozzle according to any one of Embodiments 19-27, wherein the integrated air cap/nozzle comprises two air horns, and wherein the integrated air cap/nozzle, when attached to the barrel, also defines a fan control air chamber that extends from an inlet end of a fan air barrel passage formed in the barrel to apertures located on air horns projecting past the nozzle aperture, wherein the apertures in the air horns are located on opposite sides of an axis extending through the liquid nozzle opening such that air flowing out of the fan control air chamber through the apertures on the air horns under greater than atmospheric pressure flows against opposite sides of a stream of liquid exiting the liquid nozzle opening.

Embodiment 29. An integrated air cap/nozzle according to any one of Embodiments 19-28, wherein the nozzle body comprises one or more frusto-conically shaped sections, one or more cylindrically shaped sections or a combination thereof.

Embodiment 30. A kit comprising an integrated air cap/nozzle as recited in any one of Embodiments 19-29, wherein the kit further comprises one or more integrated air cap/nozzles having a different configuration.

Embodiment 31.

A liquid spray gun comprising:

a liquid spray gun comprising a nozzle port; a removable integrated air cap/nozzle comprising a nozzle body, the integrated air cap/nozzle removably attached to the liquid spray gun, wherein the nozzle body of the integrated air cap/nozzle is positioned over the nozzle port when the integrated air cap/nozzle is attached to the liquid spray gun; and wherein the integrated air cap/nozzle comprises a liquid nozzle opening through which liquid exits during operation of the liquid spray gun and a center air outlet through which center air discharges when a liquid is sprayed through the integrated air cap/nozzle;

wherein the liquid nozzle opening and the center air outlet are formed in the removable integrated air cap/nozzle.

Embodiment 32. A liquid spray gun according to Embodiment 31, wherein the integrated air cap/nozzle further comprises a liquid port in fluid communication with the nozzle body.

Embodiment 33. A spray head assembly according to any of Embodiments 1-17 wherein the front wall comprises at least one pair of auxiliary air apertures.

Embodiment 34. A kit according the Embodiment 18 wherein the front wall comprises at least one pair of auxiliary air apertures.

Embodiment 35. An integrated air cap/nozzles according to any of Embodiments 19-29 comprising at least on pair of auxiliary air apertures.

Embodiment 36. A kit according the Embodiment 30 wherein the integrated air cap/nozzle comprises at least one pair of auxiliary air apertures.

Embodiment 37. A liquid spray gun according to Embodiment 31 wherein the integrated air cap/nozzle comprises at least on pair of auxiliary air apertures.

The above summary is not intended to describe each embodiment or every implementation of the integrated air cap/nozzles, spray head assemblies, and liquid spray gun systems described herein. Rather, a more complete understanding of the invention will become apparent and appreciated by reference to the following Description of Illustrative Embodiments and claims in view of the accompanying figures.

DESCRIPTION OF ILLUSTRATIVE EMBODIMENTS

Figure 1:
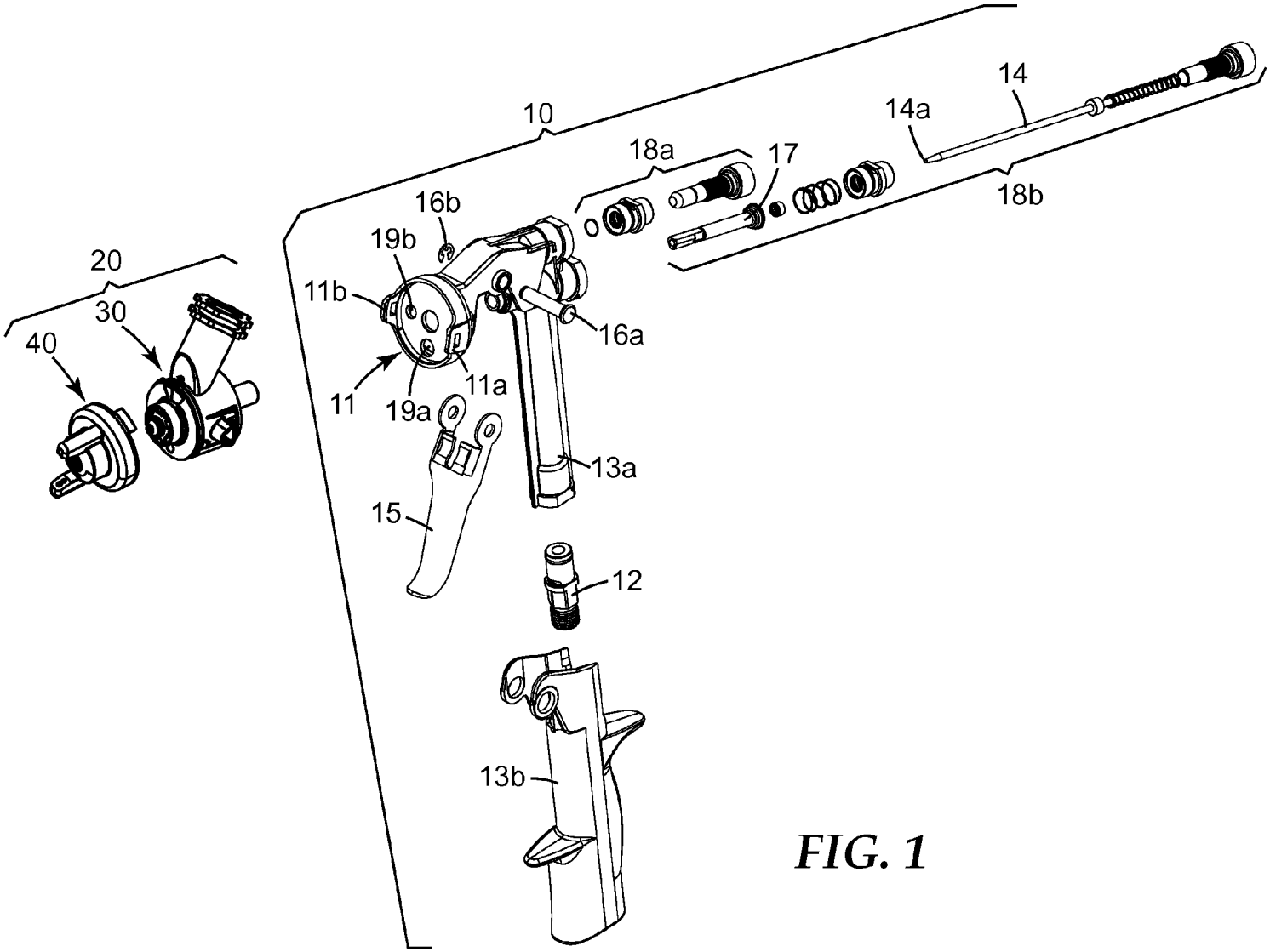
FIG. 1 is an exploded perspective view of one illustrative embodiment of a liquid spray gun as described herein.

In the following detailed description of illustrative embodiments of the liquid spray guns and components, reference is made to the accompanying figures which form a part thereof, and in which are shown, by way of illustration, specific embodiments in which the liquid spray guns and components described herein may be practiced. It is to be understood that other embodiments may be utilized and structural changes may be made without departing from the scope of the present invention.

By offering a user the ability to change the integrated air cap/nozzles during use without requiring disassembly of the remainder of the spray head assembly, changes between different nozzle tips and/or different center air outlets having different spray characteristics can be more easily performed as compared to spray head assemblies that require removal of at least the air cap and, in some instances, removal of the nozzle and/or the barrel as well (particularly in those assemblies in which the nozzle is integral with the barrel).

As used herein, a "removable" integrated air cap/nozzle is an integrated air cap/nozzle that can be removed from a nozzle port and/or a barrel to which it is attached without damaging the nozzle port and/or barrel such that a different integrated air cap/nozzle could be attached to the nozzle port and/or barrel and function properly when so attached. In some embodiments, the removable integrated air cap/nozzle itself may be damaged by removal from a nozzle port and/or barrel such that it cannot be reliably re-used, while, in other embodiments, the integrated air cap/nozzle itself may not be damaged by removal from the nozzle port and/or barrel such that it can be reliably re-used on the same or a different spray head assembly.

As used herein, the term "liquid" refers to all forms of flowable materials that can be applied to a surface using a spray gun (whether or not they are intended to color the surface) including (without limitation) paints, primers, base coats, lacquers, varnishes and similar paint-like materials as well as other materials such as adhesives, sealers, fillers, putties, powder coatings, blasting powders, abrasive slurries, mold release agents and foundry dressings which may be applied in atomized or non-atomized form depending on the properties and/or the intended application of the material and the term "liquid" is to be construed accordingly.

The words "preferred" and "preferably" refer to embodiments of the integrated air cap/nozzles, spray head assemblies, liquid spray guns, and other components described herein that may afford certain benefits, under certain circumstances. However, other embodiments may also be preferred, under the same or other circumstances. Furthermore, the recitation of one or more preferred embodiments does not imply that other embodiments are not useful, and is not intended to exclude other embodiments from the scope of the invention.

As used herein and in the appended claims, the singular forms "a," "an," and "the" include plural referents unless the context clearly dictates otherwise. Thus, for example, reference to "a" or "the" component may include one or more of the components and equivalents thereof known to those skilled in the art. Further, the term "and/or" means one or all of the listed elements or a combination of any two or more of the listed elements.

It is noted that the terms "comprises" and variations thereof do not have a limiting meaning where these terms appear in the accompanying description. Moreover, "a," "an," "the," "at least one," and "one or more" are used interchangeably herein.

Relative terms such as left, right, forward, rearward, top, bottom, side, upper, lower, horizontal, vertical, and the like may be used herein and, if so, are from the perspective observed in the particular figure. These terms are used only to simplify the description, however, and not to limit the scope of the invention in any way.

The integrated air cap/nozzles and/or spray head assemblies described herein are preferably constructed to receive air from the center air passages of liquid spray guns or liquid spray gun platforms to which they are attached. The spray head assemblies may, in some embodiments, include fan air chambers that receive fan air from a fan air passage in the attached spray gun platforms in addition to center air chambers that receive center air from a center air passage in the attached spray gun platforms.

Although described herein in combination with each other, the integrated air cap/nozzles and spray head assemblies described herein that include barrels may each be used separately with other components to provide a liquid spray gun. For example, the liquid spray gun platforms described herein could be used with any spray head assembly that was designed to operably connect to a barrel interface of the liquid spray gun platform. Similarly, the spray head assemblies could be used with other liquid spray gun platforms that have a barrel interface designed to accept the spray head assemblies described herein.

The liquid spray guns, spray gun platforms, and spray head assemblies described herein may be used in a liquid spray delivery system in which a container of liquid to be dispensed is mounted on the liquid spray gun, although in other embodiments liquid could be supplied from other sources that may, e.g., be connected to the liquid spray gun by, e.g., a supply line, etc. The liquid spray guns described herein may preferably be sized for use as a hand-held spray gun and may be used in methods that involve the spraying of one or more selected liquids.

The integrated air cap/nozzles and spray head assemblies described herein are adapted to atomize a liquid to form a spray. For example, the integrated air cap/nozzle and spray head assembly may be arranged to mix the liquid emerging from a nozzle with a supply of compressed air. In some embodiments, liquid emerging from the nozzle can be further mixed with air streams directed onto the liquid from two sides to further atomize the liquid and/or shape the spray pattern. The air streams may be adjusted to adapt the spray head assembly for dispensing different media. Although many embodiments of the spray head assemblies described herein are provided as a composite article formed using an integrated air cap/nozzle assembled on a barrel that is, itself, attached to a liquid spray gun platform, in other embodiments, the spray head assemblies may include only an integrated air cap/nozzle attached to a liquid spray gun platform that includes an integrated barrel.

Although the illustrative embodiments of the integrated air cap/nozzles described herein include optional air horns to provide air streams that can be directed onto the atomized liquid emerging from the nozzle tip from two or more sides, the integrated air cap/nozzles as described herein may or may not include air horns or any other structures configured to provide air streams that can be directed onto the liquid emerging from the nozzle from two or more sides. Furthermore, although the illustrated air horns are shown in specific orientations, it should be understood that they may be provided in any selected arrangement and orientation with respect to the atomized liquid emerging from the nozzle tip.

In some embodiments (some illustrative examples of which are described in more detail below), the integrated air cap/nozzles described herein are adapted for use in a spray head assembly that can be attached to a liquid spray gun. The spray head assembly itself includes a barrel and an integrated air cap/nozzle. The integrated air cap/nozzle includes a liquid nozzle opening through which liquid exits during operation of the liquid spray gun and a center air outlet through which center air discharges when a liquid is sprayed through the integrated air cap/nozzle.

The integrated air cap/nozzle is removably attached to the spray head assembly over the nozzle port such that liquid passing through the nozzle port passes into a nozzle passage in the integrated air cap/nozzle before exiting through the liquid nozzle opening of the integrated air cap/nozzle. In addition, the integrated air cap/nozzle can be disengaged from the spray head assembly, such that, as discussed herein, the integrated air cap/nozzles can be changed without disturbing the remainder of the liquid spray gun. Because the liquid nozzle opening and the center air outlet are both defined within the integrated air cap/nozzle, the dimensions of both the liquid nozzle opening and the center air outlet are defined entirely by the integrated air cap/nozzle (as opposed to conventional spray head assemblies in which an air cap that is separate and distinct from the nozzle defines, at least in part, the dimensions of the center air outlet).

One illustrative embodiment of a liquid spray gun as described herein is depicted in the exploded view of FIG. 1. The same liquid spray gun is depicted as assembled in FIG. 2. The liquid spray gun includes a variety of components including a liquid spray gun platform 10 and a spray head assembly 20 that is preferably releasably attached to the liquid spray gun platform 10 at a barrel interface 11. The spray head assembly 20 is preferably releasably attached to the platform 10 and provides features that control movement of both the liquid to be sprayed and the air used to atomize the liquid as described herein. In some embodiments, the spray head assembly 20 and/or portions thereof are disposable and can be thrown away after use (although in some instances it may be reused). If disposed after use, cleaning of the spray head assembly and/or portions thereof can, in some embodiments, be avoided and the spray gun can be conveniently changed over by, e.g., attaching a different spray head assembly connected to the same or a different liquid container.

Connection of the spray head assembly 20 to barrel interface 11 of the spray gun platform 10 may be achieved by any suitable technique. For example, connection structures on the spray head assembly 20 may cooperate (e.g., mechanically interlock) with the openings 11*a* and 11*b* at the barrel interface 11 to retain the spray head assembly 20 on the spray gun platform 10 as described herein. Many other connection techniques and/or structures may be used in place of those described herein, e.g., a bayonet type connection that facilitates rapid connection/disconnection of the spray head assembly with a simple push or push-twist action, clamps, threaded connections, etc.

The spray gun platform 10 may also include an optional handle 13*b* that fits over the stem portion 13*a* of the frame. The handle 13*b* may, in some embodiments, be custom designed according to the operator's preference, including custom fitting by means of a thermosetting resin. Custom-fitted handles may reduce operator fatigue by allowing for a grip surface that can be custom molded to fit the hand of an individual user. The handle 13*b* may, in some embodiments, be formed from a thermosetting resin and an intended user of the spray gun can grasp the handle while the resin is in an unhardened condition to impart a contoured surface to the handle that is customized for the hand of that user. In those embodiments in which the handle 13*b* is detachable from the stem portion 13*a* of the frame, similar handles can be readily prepared for other users of the spray gun which allows a single spray gun to be accompanied by an array of handles, each of which has a grip surface that has been custom-fitted to the hand of a different intended user.

The platform 10 may be constructed of any suitable material that can be molded, cast, etc. to form the features described herein. Examples of some potentially suitable materials may include, e.g., metals, metal alloys, polymers (e.g., polyurethanes, polyolefins (e.g., polypropylenes), polyamides (e.g., nylons including amorphous nylons), polyesters, fluoropolymers, and polycarbonates), and others. If polymeric materials are used to construct the platforms, the polymeric material may include any suitable additives, fillers, etc., such as, e.g., glass fiber, glass or polymeric bubbles or microbubbles, electrically conductive and/or static dissipating materials such as, e.g., finely divided metals, metal salts, metal oxides, carbon or graphite, etc. Selection of the materials used in the platforms described herein may preferably be based at least in part on the compatibility of the selected materials with the materials to be sprayed (e.g., solvent resistance and other characteristics may need to be considered when selecting the materials used to construct the platforms).

Figure 2:
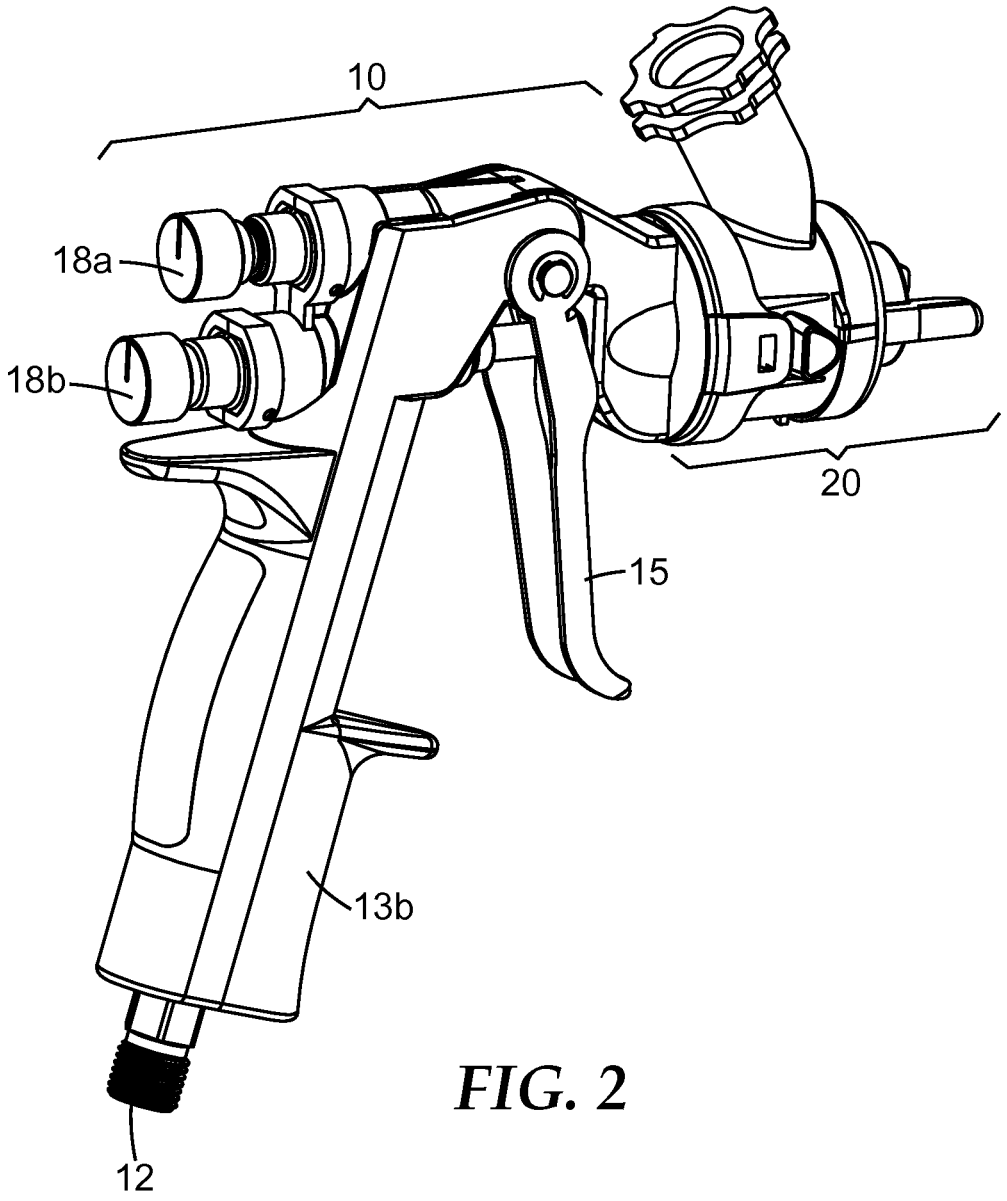
FIG. 2 is a perspective view of the liquid spray gun of FIG. 1 after assembly.

The spray gun platform 10 depicted in FIGS. 1 and 2 may, in some embodiments, define a variety of cavities that, taken together, form the passages that deliver air to the spray head assembly 20. Among other features, the spray gun platform 10 includes a fitting 12 such that the air supply passages in the spray gun platform 10 can be connected to an air source (not shown) that supplies air to the spray gun platform 10 at greater than atmospheric pressure.

A needle passage is also provided in the spray gun platform 10 to allow a needle 14 to pass into a spray head assembly attached to the barrel interface. Referring to FIGS. 1 and 2, control over both air flow and liquid flow through the liquid spray gun is, in the depicted embodiment, provided by a trigger 15 that is pivotally engaged to the spray gun platform 10 by a retaining pin 16*a* and clip 16*b* (although any other suitable connection mechanism could be used). The needle 14 extends through the spray head assembly 20 in a manner similar to that described in, e.g., U.S. Pat. No. 7,032,839 (Blette et al.). The trigger 15 is preferably biased to the inoperative position in which needle 14 closes the liquid nozzle opening in the spray head assembly 20 and also closes an air supply valve 17. The biasing force may be provided by a coil spring (positioned between air supply valve 17 as part of the center air control assembly 18*b*), although other biasing mechanisms may be used and those biasing mechanisms may be located in other positions (e.g., between the trigger 15 and the handle 13*b*).

When the trigger 15 is depressed, needle 14 is retracted to a position in which tapered front end 14*a* allows liquid to flow through liquid nozzle opening in the spray head assembly 20. At the same time, air supply valve 17 also opens to deliver air to the spray head assembly 20 from the passages in the spray gun platform 10. Air and liquid flow may be further controlled by a fan air control assembly 18*a* which controls air delivered to a fan air passage outlet 19*a* from the air supply manifold in the platform 10 and center air control assembly 18*b* which controls air delivered to a center air passage outlet 19*b* from the air supply manifold in the platform 10. In particular, the control assembly 18*b* controls the center air/liquid stream emanating from the spray head assembly 20, and control assembly 18*a* controls air flow to the air horns (if provided) of the spray head assembly 20 to adjust the spray pattern geometry. In some embodiments, however, it should be understood that adjustment of the center air control assembly 18*b* may affect air flow through the fan air control assembly 18*a* (or vice versa).

Further details regarding various embodiments of spray gun platforms that may be used in connection with the integrated air cap/nozzles and spray head assemblies described herein to provide a complete liquid spray gun may be described in US Patent Application Publications US 2010/0187333 (Escoto, Jr. et al.); US 2004/0140373 (Joseph et al.); US 2006/0065761 (Joseph et al.) and US 2006/0102550 (Joseph et al.); as well as U.S. Pat. No. 6,971,590 (Blette et al.); U.S. Pat. No. 6,820,824 (Joseph et al.); U.S. Pat. No. 6,971,590 (Blette et al.); U.S. Pat. No. 7,032,839 (Blette et al.); U.S. Pat. No. 7,201,336 (Blette et al.); and U.S. Pat. No. 7,484,676 (Blette et al.).

Some illustrative embodiments of the integrated air cap/nozzles and/or spray head assemblies that may be used with the spray gun platforms to provide complete liquid spray guns are described herein. Although the illustrative embodiments of integrated air cap/nozzles and spray head assemblies described herein may be advantageously used with spray gun platforms, the described embodiments are illustrative only and other integrated air cap/nozzles and/or spray head assemblies may be substituted for those described herein to provide a complete liquid spray gun.

As seen in FIGS. 1 and 3-5, some embodiments of the spray head assemblies described herein may be provided in the form of a combination of different components that are connected to each other to form a completed spray head assembly 20. More specifically, an exemplary spray head assembly 20 may include a barrel 30 and an integrated air cap/nozzle 40. The barrel 30 and integrated air cap/nozzle 40 of the spray head assembly 20 preferably combine to form cavities and passageways that deliver the center air and the fan control air in a substantially separated manner through the spray head assembly.

Figure 3:
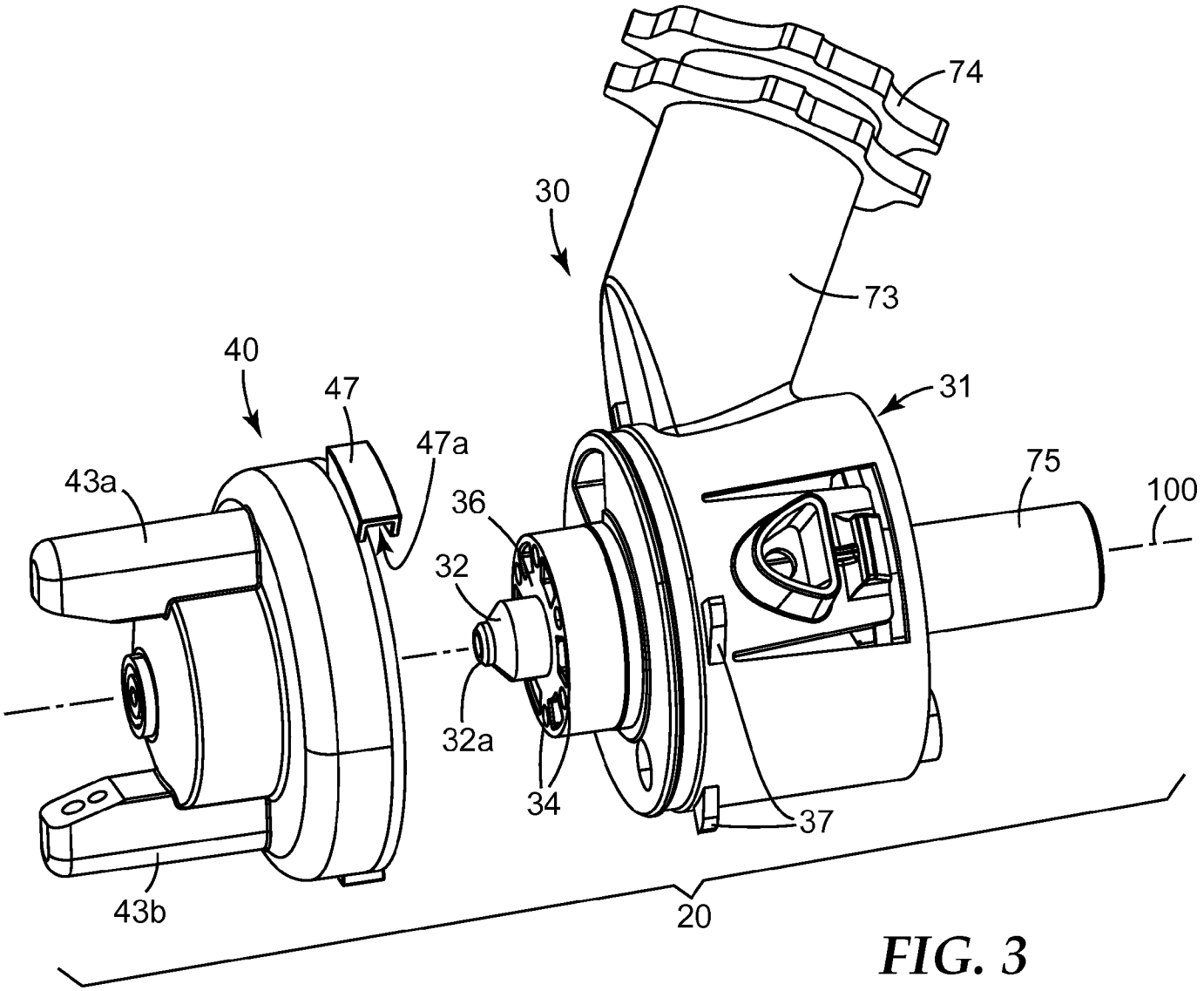
FIG. 3 is an exploded perspective view of one illustrative embodiment of a spray head assembly as described herein.
Figure 4:
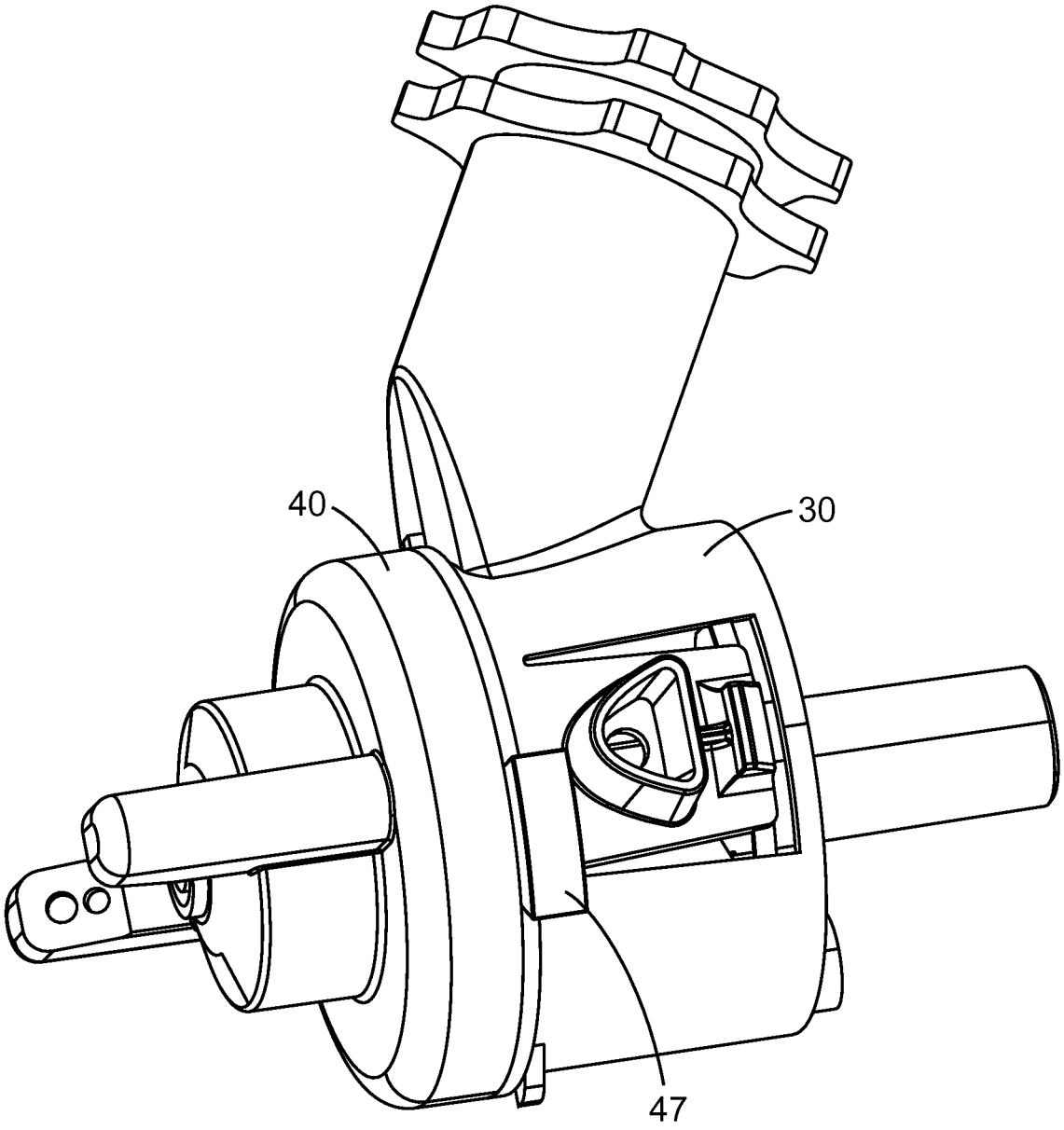
FIG. 4 is a perspective view of the spray head assembly of FIG. 3 as assembled.
Figure 5:
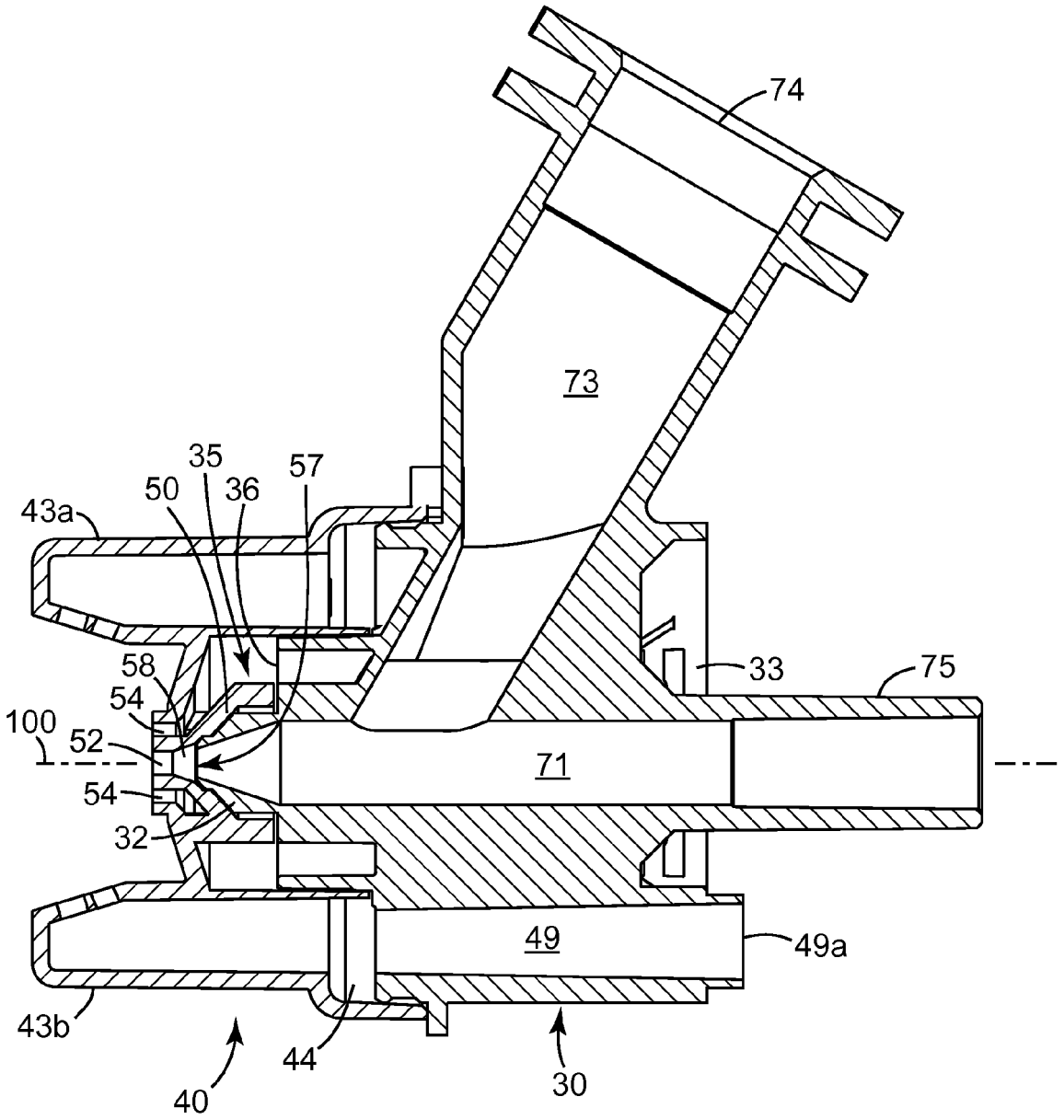
FIG. 5 is a vertical cross-sectional view of the spray head assembly of FIG. 3.

Referring to FIGS. 3-5, exemplary barrels 30 may include various features described in connection with the barrels taught in US Patent Publication US 2010/0187333 (Escoto Jr. et al.) and U.S. Pat. No. 6,971,590 (Blette et al.) including a barrel inlet 31 that preferably seals with the barrel interface 11 on a spray gun platform to which the barrel 30 is attached.

One difference between the spray head assemblies described herein and the spray head assemblies described in US Patent Publication US 2010/0187333 (Escoto Jr. et al.) and U.S. Pat. No. 6,971,590 (Blette et al.) is, however, that the barrel 30 does not, itself, form the liquid nozzle opening through which liquid being sprayed exits the spray gun platform. Rather, the nozzle body 50 attached to or formed in the integrated air cap/nozzle is positioned over a liquid nozzle port 32 on the barrel 30, with the nozzle body 50 including the liquid nozzle opening 52 through which liquid being sprayed exits from the integrated air cap/nozzle 40 of the spray head assembly 20.

The barrel 30, as a result, includes features that define a liquid passageway 71 that terminates in the liquid nozzle port 32 through which the liquid to be sprayed exits the barrel 30 and enters the nozzle passage 58 of nozzle body 50 (see, e.g., FIG. 5). Liquid enters the liquid passageway in the barrel 30 from a liquid port 74, which may be connected to the barrel by an inlet passage 73. As mentioned above, a source of liquid to be sprayed (not shown), such as a container, a supply line or another structure, may be connected (e.g., removably connected) to the liquid port 74. The liquid passageway 71 defined in the barrel 30 may preferably be isolated from the other features in the barrel 30. The liquid passageway 71 may preferably be sized to receive a needle 14 (see, e.g. FIG. 1) that is capable of closing the liquid nozzle opening 52 when advanced in the forward direction (to the left in the views depicted in FIGS. 1, 3 and 4) and opening the liquid nozzle opening 52 when retracted in the rearward direction (to the right in FIGS. 1, 3, and 4). The liquid passageway 71 may further include a needle housing extension 75 that extends rearward of the barrel 30 and may preferably fit within a needle passage in the liquid spray gun platform 10.

The barrel wall of the barrel 30 defines a barrel cavity 33 that surrounds the liquid passageway 71. The barrel cavity 33 receives air flowing out of the center air passage outlet 19*b* (see, e.g., FIG. 1) in the barrel interface 11 of the spray gun platform 10. As a result, the barrel cavity 33 defines a portion of a center air chamber within the spray head assembly 20. The center air entering the barrel cavity 33 passes through the barrel 30 and exits the barrel cavity 33 through one or more openings 34 provided in the barrel 30.

The openings 34 in the barrel 30 deliver the center air exiting the barrel cavity 33 to a nozzle cavity 35 formed between the integrated air cap/nozzle 40 and the front wall 36 of the barrel 30. Air entering the nozzle cavity 35 flows through the nozzle cavity 35 until it exits the nozzle cavity though the center air outlet 54 formed in the integrated air cap/nozzle 40. Together, the barrel cavity 33 and the nozzle cavity 35 combine to form a portion of what can be characterized as the center air chamber of the spray head assembly 20. As described herein, the center air chamber essentially extends from the barrel inlet 31 to the center air outlet 54 of the spray head assembly 20. The center air outlet 54 may, in some embodiments, be disposed about the liquid nozzle opening 52 such that the center air passing through the center air outlet 54 can atomize and form the liquid passing through the liquid nozzle opening 52 into a generally conical stream. Particularly, in the illustrated embodiment, the center air outlet 54 comprises an annularly shaped opening surrounding the liquid nozzle opening 52 in a concentric fashion.

Generally, a nozzle body according to the present disclosure can comprise any suitable structure that defines the configuration (e.g., dimensions and position) of the opening through which liquid being sprayed exits from the integrated air cap/nozzle 40 (here, the liquid nozzle opening 52). Preferably, the nozzle body 50 also defines the center air outlet 54. As explained above, the nozzle body forms a nozzle passage 58 that terminates in the liquid nozzle outlet 52. In typical embodiments of the present disclosure, the nozzle passage 58 is characterized by a smaller diameter proximate the liquid nozzle outlet and a larger diameter proximate a nozzle body inlet 57. In some embodiments, the nozzle passage 58 comprises one or more frusto-conically shaped sections, one or more cylindrically shaped sections or a combination thereof.

Exemplary dimensions of nozzle bodies according to the present disclosure include internal diameters of liquid nozzle openings of about 0.1 mm to about 3.0 mm. Other suitable dimensions are within the scope of the present disclosure, e.g., depending on the viscosity of the liquid being sprayed and also whether or not the liquid is being fed under gravity or is pressurized. An exemplary internal diameter of center air outlet may be about 4.8 mm. However, other suitable dimensions are within the scope of the present disclosure, and the internal diameter of center air outlet may be smaller or larger.

Similarly, a nozzle port according to the present disclosure can comprise any suitable structure that interfaces with a nozzle body according to the present disclosure, preferably to form a fluid-tight seal and, more preferably, a liquid tight seal. For example, referring to FIGS. 3 and 5, the exemplary nozzle port 32 is a structure that projects from the front wall 36 of the barrel 30. Nozzle port may have an outer surface configured to include one or more frusto-conically shaped sections, one or more cylindrically shaped sections or a combination thereof. In some embodiments, the nozzle port 32 may include a liquid passageway 71 that is characterized by a smaller diameter proximate the outlet of the nozzle port and a larger diameter further from the outlet of the nozzle port. In some exemplary embodiments, the liquid passageway 71 may comprise a frusto-conically shaped section. Other exemplary nozzle ports may include one or more frusto-conically shaped sections, one or more cylindrically shaped sections or a combination thereof. Exemplary dimensions of nozzle bodies according to the present disclosure would typically be selected to correspond to the dimensions of the nozzle body.

The integrated air cap/nozzle 40, as discussed above, preferably provides both the liquid nozzle opening 52 and the center air outlet 54 of the spray head assembly 20. The integrated air cap/nozzle 40 is removably attached to the barrel 30 over the liquid nozzle port 32. In the depicted embodiment, the integrated air cap/nozzle 40 may be attached to the barrel 30 by a bayonet mounting structure. In that embodiment, rotation of the integrated air cap/nozzle 40 about the axis 100 engages the bayonet mounting structure such that the integrated air cap/nozzle 40 is retained on the barrel 30.

An exemplary structure for removably connecting an integrated air cap/nozzle 40 to a barrel 30 includes one or more projections 37 on the barrel 30 and one or more corresponding engaging members 47 (seen in, e.g., FIGS. 3 and 4) on the integrated air cap/nozzle 40. Preferably, one or more of engaging features 47 includes a channel 47*a* (seen in, e.g., FIG. 3) configured and dimensioned to receive a projection 37 through its open end and having a stop (not shown) on another end thereof, such that a projection 37 received through the open end of the channel is not capable of passing all the way through. Alternatively, the channel 47*a* could be open ended but having a varying cross-section such that a projection 37 would essentially wedge itself at some predetermined position as opposed to hitting a stop (not shown) or a closed end of the channel 47*a*. In other exemplary embodiments, the respective locations of the projections 37 and engaging members 47 may be changed, with one or more of the former being located on the integrated air cap/nozzle 40 and one or more of the latter being located on the barrel 30.

Figure 15:
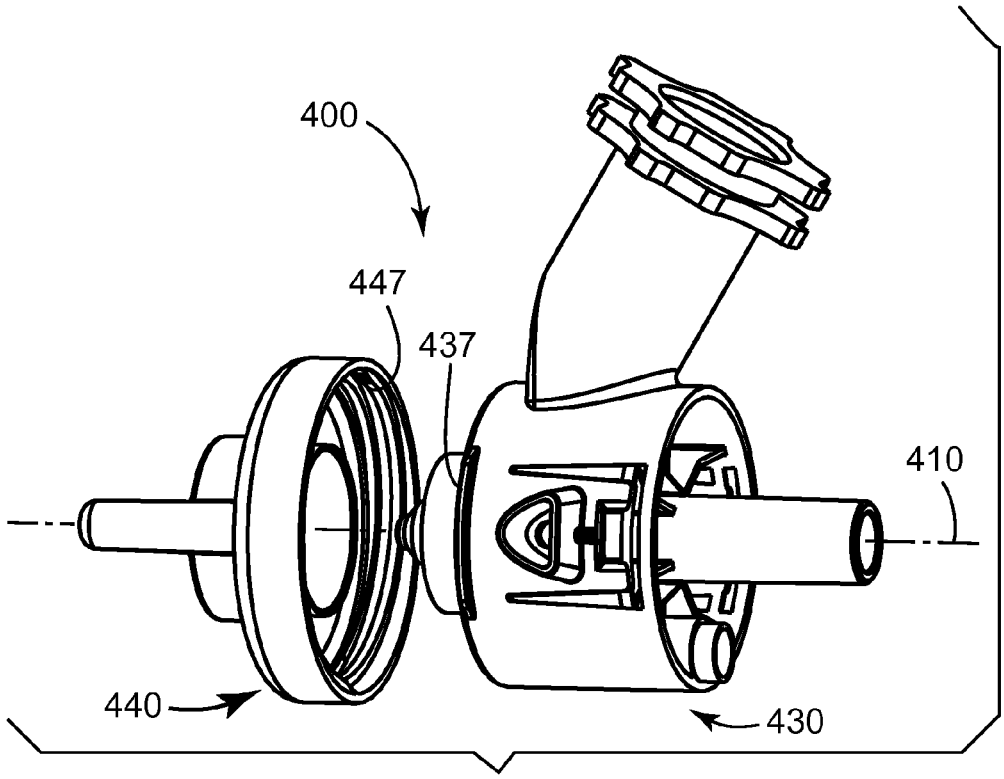
FIG. 15 illustrates an alternative exemplary structure for removably connecting an integrated air cap/nozzle to a barrel.

Other potential connection mechanisms that could be used to attach the integrated air cap/nozzle 40 to the barrel 30 may include, e.g., a threaded connection, a Luer lock connection, or another suitable structure. FIG. 15 illustrates an exemplary Luer lock structure 400 for removably connecting an integrated air cap/nozzle 440 to a barrel 430. The exemplary structure includes at least one ledge 437 projecting from an outer surface of the barrel 430. Preferably at least two ledges 437 are provided on opposing sides of the outer surface of the barrel 430. The one or more ledges 437 are configured such that they cooperate with a thread 447 provided on an internal surface of the integrated air cap/nozzle 440 to removably attach the integrated air cap/nozzle 440 on the barrel 430. Particularly, a rotation of the integrated air cap/nozzle 440 about the axis 410 engages the at least one ledge 437 with the thread 447.

Figure 16:
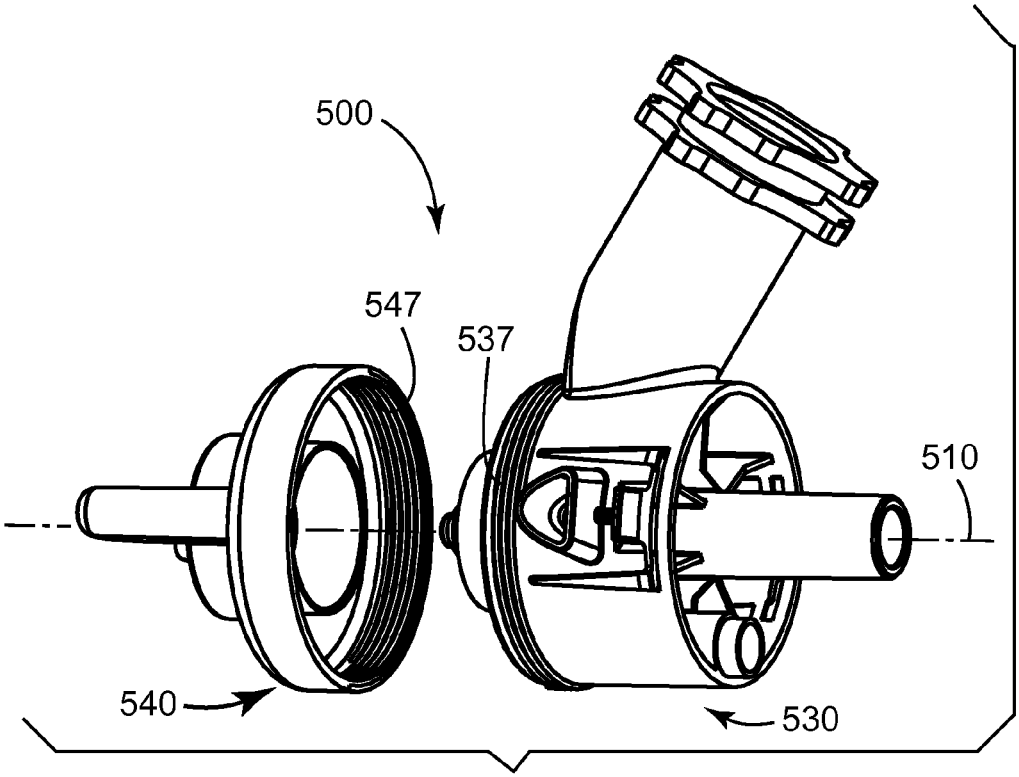
FIG. 16 illustrates another exemplary structure for removably connecting an integrated air cap/nozzle to a barrel.

Yet another exemplary structure 500 for removably connecting an integrated air cap/nozzle 540 to a barrel 530 is illustrated in FIG. 16. The exemplary structure 500 includes a threaded connection having a male thread 537 disposed on an outer surface of the barrel 530 and a female thread 547 disposed on an inner surface of the integrated air cap/nozzle 540.

The threads 537 and 547 are configured such that they cooperate to removably attach the integrated air cap/nozzle 540 on the barrel 530, for example, via a rotation of the integrated air cap/nozzle 540 about the axis 510.

Thus, in some embodiments, one or more features of a structure for removably connecting an integrated air cap/nozzle to a barrel are disposed on an outer surface of the integrated air cap/nozzle with one or more mating features disposed on an outer surface of the barrel. In other exemplary embodiments, as illustrated in FIGS. 15 and 16, one or more features of a structure for removably connecting an integrated air cap/nozzle to a barrel are disposed on an inner surface of the integrated air cap/nozzle with one or more mating features disposed on an outer surface of the barrel, or vice versa. Generally, in exemplary embodiments of the present disclosure the one or more structures for removably connecting an integrated air cap/nozzle to a barrel are spaced apart from the nozzle body and/or the nozzle port. Particularly, the nozzle body and the nozzle port would typically be located in the middle area of the integrated air cap/nozzle and that of the barrel, while one or more structures for implementing the removable connection would typically be located away from the middle area and, preferably, at or out towards a periphery of the integrated air cap/nozzle and that of the barrel. There are various advantages associated with such a physical separation of these elements, such as convenient user access to the connecting structures, ability to design internal structures independently from the connecting structures, which allows more flexibility and potential manufacturing advantages.

As described herein, a removable integrated air cap/nozzle such as the illustrative embodiment depicted in FIGS. 3-7 is an integrated air cap/nozzle 40 that can be removed from the nozzle port 32 and the barrel 30, together with the nozzle body 50, without damaging the nozzle port 32 and the barrel 30 such that it could be later re-positioned or a different integrated air cap/nozzle could be positioned over the nozzle port 32 and attached to the barrel 30 and function properly.

Figure 6:
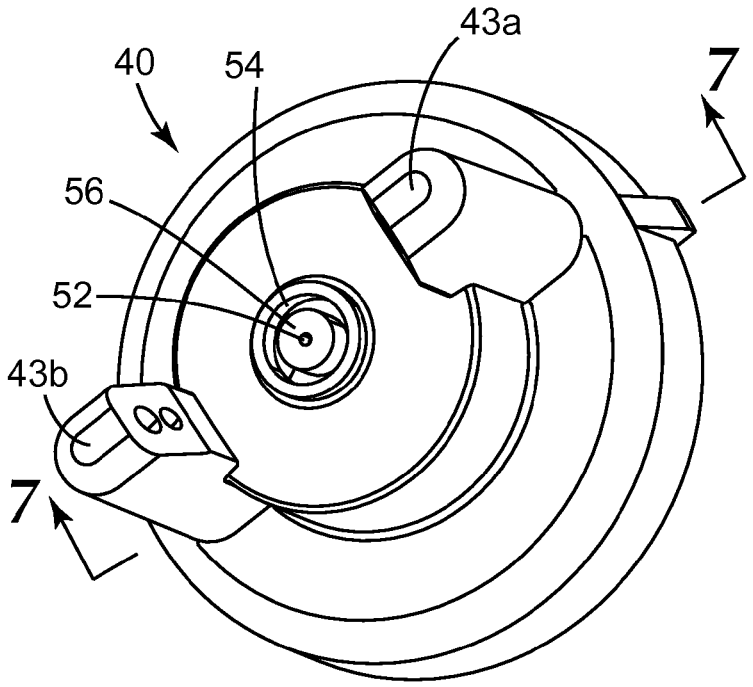
FIG. 6 is a perspective view of one illustrative embodiment of the integrated air cap/nozzle of FIGS. 3-6.
Figure 7:
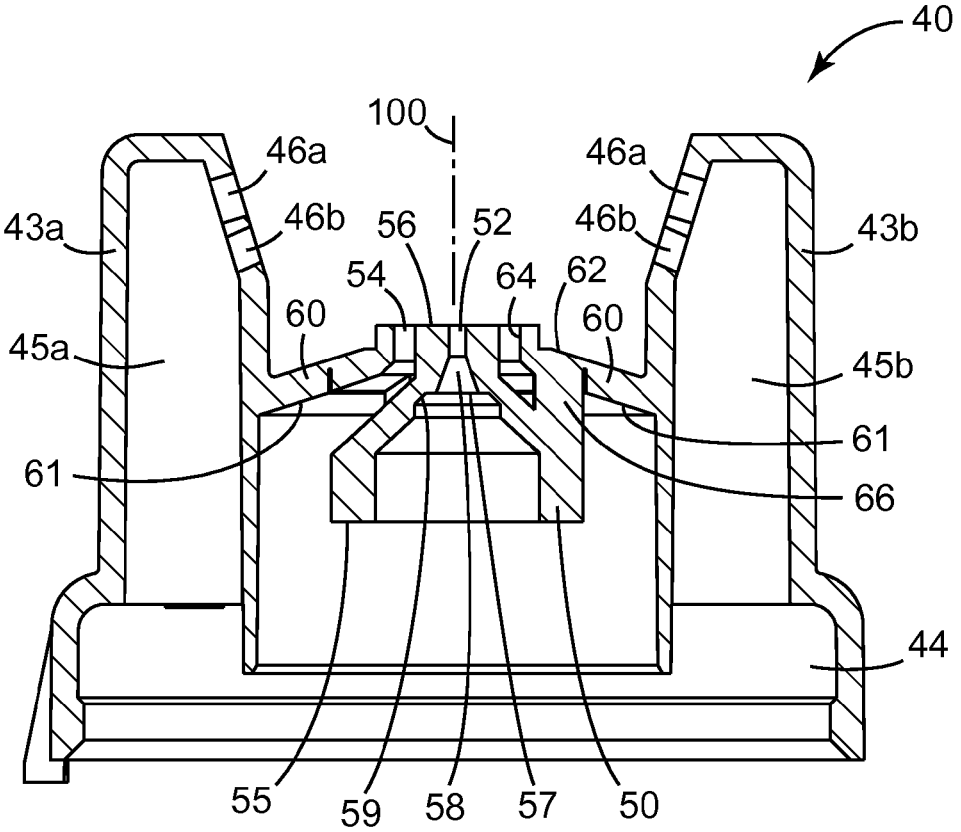
FIG. 7 is a cross-sectional view of the integrated air cap/nozzle of FIG. 6 taken along line 7-7 in FIG. 6.

FIGS. 6-7 depict alternate views of the integrated air cap/nozzle 40 seen in FIGS. 1 and 3-5. In particular, the integrated air cap/nozzle 40 has a cap body that includes a nozzle body 50. The nozzle body 50 defines a liquid nozzle opening 52 and a center air outlet 54. In accordance with the present disclosure, the nozzle body 50 is a part of the cap body of the air cap/nozzle 40, such that the entire construction could be removed from the barrel 30 as mentioned above, preferably without using any tools. In one embodiment, the body of the integrated air cap/nozzle 40 includes a front wall 60 that is attached to the nozzle body 50 by one or more support members 66 (one of which is depicted in cross-section in FIG. 7). In one exemplary embodiment, the front wall 60 includes a nozzle aperture 64 that, together with a nozzle body end 56 located within the nozzle aperture 64 defines the center air outlet 54. The front wall 60, in the depicted embodiment, extends between the optional air horns 43*a* and 43*b* and also assists in defining the nozzle cavity 35 within the integrated air cap/nozzle 40.

Thus, in an exemplary embodiment, the nozzle body 50 defines a liquid nozzle opening 52 and the center air outlet 54 in conjunction with the nozzle aperture 64 in the front wall 60. In some embodiments, the liquid nozzle opening 52 may be circularly shaped, while the center air outlet 54 may be annularly shaped. The nozzle body 50 includes an inlet end 55 and a nozzle outlet end 56. The liquid nozzle opening 52 is formed in the nozzle outlet end 56 of the nozzle body 50, while a nozzle body inlet 57 is also formed in the nozzle body 50 at the opposite end of a nozzle passage 58 (see, e.g., FIG. 7) that connects the nozzle body inlet 57 to the liquid nozzle opening 52. As a result, the nozzle passage 58 can be described as extending through the nozzle body 50 from the nozzle body inlet 57 to the liquid nozzle opening 52, such that liquid entering the nozzle passage 58 through the nozzle body inlet 57 leaves the nozzle body 50 through the liquid nozzle opening 52 after passing through the nozzle passage 58. The depicted nozzle passage 58 is tapered such that the cross-sectional area of the nozzle passage 58 decreases when moving through the nozzle passage 58 from the nozzle body inlet 57 towards the liquid nozzle opening 52. The nozzle passages in other nozzle bodies may alternatively have a constant cross-sectional area, or may take any other selected shape.

As described herein, the nozzle body 50 is positioned over a nozzle port 32 on the barrel 30 when the integrated air cap/nozzle 40 is attached to the barrel 30 by an attachment structure, such as exemplary removable attachment structures described above. Preferably, the nozzle port 32 forms a fluid-tight (e.g., air, liquid or both) connection with the nozzle body 50. Accordingly, the nozzle body 50 may include a nozzle sealing surface 59, such that when a corresponding surface or structure of the nozzle port 32 (e.g., a slanted surface 32*a*) abuts the nozzle sealing surface 59, the nozzle body 50 forms a sufficiently tight seal with the nozzle port 32 when the integrated air cap/nozzle 40 is attached to the barrel 30 such that liquid exiting the nozzle port 32 enters the nozzle passage 58 in the nozzle tip 50 without leaking into the center air chamber under normal operating conditions. The sealing surface 59 may, in some embodiments, include a gasket, O-ring or other sealing element to assist in formation of the seal. In addition, the sealing surface may be provided in other locations. One potential alternative may be an annular rib or other sealing element that could be provided on an outer surface of the nozzle port 32 or any other surface found at the junction of the nozzle port 32 and the nozzle body 50. Generally, it is preferred that a seal between the nozzle body 50 and the nozzle port be disposed proximate the first point of contact between the nozzle body 50 and the barrel 30, but other alternative and/or additional location of the seal are within the scope of the present disclosure.

The integrated air cap/nozzle 40 may include an internal surface 61 that faces generally toward the inlet end 55 of the nozzle body 50 and an external surface 62 that faces generally away from the inlet end 55 of the nozzle body 50. The space or volume formed between the internal surface 61 of the front wall 60 and the nozzle body 50 forms a part of the center air chamber (which also includes the barrel cavity 33 and the nozzle cavity 35 as described herein).

As described herein, the front wall 60 further includes a nozzle aperture 64 that extends through the front wall 60. A nozzle aperture 64 may be larger than the nozzle outlet end 56 of the nozzle body 50 and the nozzle outlet end 56 of the nozzle body 50 may be located in the nozzle aperture 64 such that a gap is found between the nozzle aperture 64 and the nozzle outlet end 56 of the nozzle body 50. That gap between the nozzle aperture 64 and the nozzle outlet end 56 may form the center air outlet 54 in the integrated air cap/nozzle 40. Air entering the center air chamber from the liquid spray gun platform thus may pass through the center air outlet 54 around the nozzle outlet end 56 of the nozzle body 50. Because of the arrangement of the front wall 60 and the nozzle body 50, the nozzle passage 58 in the nozzle body 50 and the center air chamber are independent of each other such that liquid exiting the nozzle passage through the liquid nozzle opening 52 and air exiting the center air chamber through the center air outlet 54 are preferably separated from each other until they exit their respective orifices.

The nozzle body 50 may be attached to the body of the integrated air cap/nozzle 40 by any suitable structure, such that, when the integrated air cap/nozzle 40 is detached from the barrel 30, the nozzle body 50 is capable of remaining attached to the body of the integrated air cap/nozzle 40. In the illustrative embodiment depicted in FIGS. 6-7, the nozzle body 50 is attached to the front wall 60 by support members 66 that extend between the nozzle body 50 and the front wall 60. In the depicted embodiment, the nozzle body 50 is attached by three support members 66, although as few as one or two support members or more than three support members may be used to attach the nozzle body 50 to the front wall 60. The support member or members may take any suitable form so long as they connect the nozzle body to the integrated air cap/nozzle 40 and allow center air to flow through the center air outlet 54.

The embodiment of an integrated air cap/nozzle 40 depicted in FIGS. 6 and 7 also includes at least one optional pair of air horns 43*a* and 43*b*, each of which defines a horn cavity 45*a* and 45*b* (respectively) into which fan air enters from the barrel 30. Fan air delivered into the air horn cavities 45*a* and 45*b* exits the cavities through one or more apertures 46*a* and 46*b* on each of the air horns 43*a* and 43*b*. The apertures 46*a* and 46*b* on the horns 43*a* and 43*b* are located on opposite sides of the axis 100 such that air flowing through the fan air chamber under greater than atmospheric pressure flows against opposite sides of a stream of atomized liquid formed by air flowing through the center air chamber. The forces exerted by the fan air can be used to change the shape of the stream of atomized liquid to form a desired spray pattern (e.g., circular, elliptical, etc.). The size, shape, orientation, and other features of the apertures may be adjusted to achieve different fan control characteristics as described in, e.g., U.S. Pat. No. 7,201,336 B2 (Blette). In the depicted embodiment, the apertures 46*a* and 46*b* are in the form of circular bores.

Fan air is delivered into the fan air chamber in the spray head assembly 20 from the spray gun platform 10 through fan air passage outlet 19*a* in the barrel interface 11 (see, e.g., FIG. 1). Isolation of the fan air from the center air may be maintained since the fan air passes through the barrel 30 by directing the fan air through a fan air barrel passage 49 formed in the barrel 30 (see, e.g., FIG. 5). Air enters the fan air barrel passage 49 through an inlet end 49*a* from the fan air passage outlet 19*a* of the platform 10 and is delivered into a ring cavity 44 in the integrated air cap/nozzle 40 for distribution to the air horn cavities 45*a* and 45*b*. The fan air barrel passage 49, the ring cavity 44, and the air horn cavities 45*a* and 45*b* form a part of the fan air chamber of the spray head assembly 20.

Figure 8:
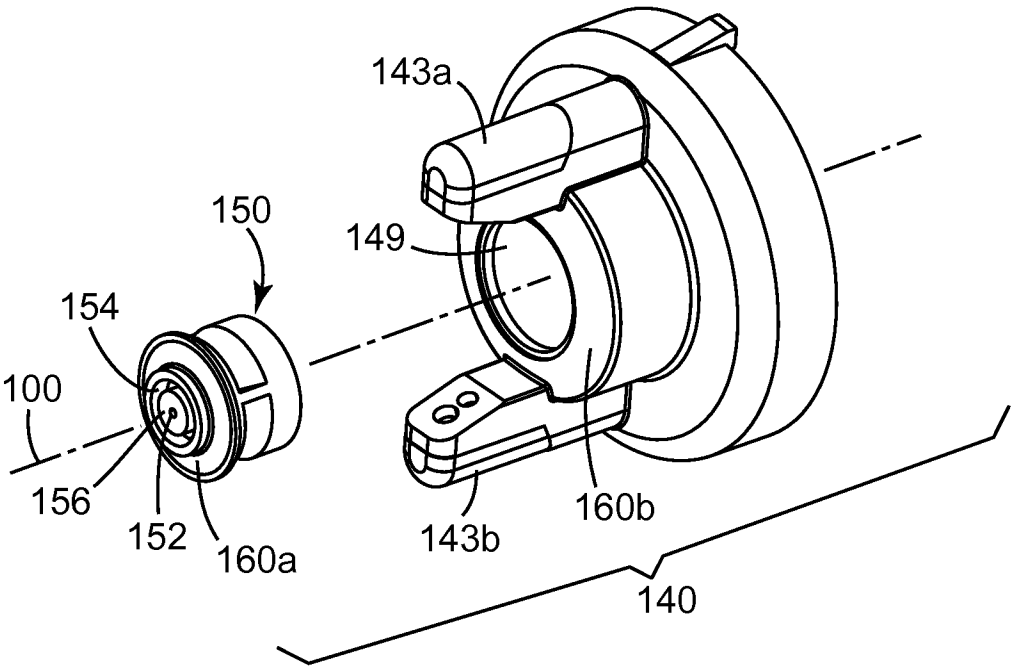
FIG. 8 is an exploded perspective view of another embodiment of an integrated air cap/nozzle.

Another illustrative embodiment of an integrated air cap/nozzle 140 is depicted in FIG. 8 in which a nozzle body 150 is assembled and attached to the remainder of the body of the integrated air cap/nozzle 140 to form a complete integrated air cap/nozzle 140 defining a spray axis 100. In this embodiment, the nozzle body 150 includes first front wall portion 160*a* that can be positioned in an aperture 149 in the second front wall portion 160*b*, with the portions 160*a* and 160*b* combining to form the front wall of the integrated air cap/nozzle 140. In the illustrative embodiment depicted in FIG. 8, the front wall portion 160*a* may be attached to the front wall portion 160*b* by any suitable technique that securely attaches the nozzle body 150 to the remainder of the integrated air cap/nozzle 140, e.g., snap-fit attachment, threaded attachment, press fit, adhesives, welding (thermal, ultrasonic, and/or chemical), etc. As used herein, "securely attached" (and variations thereof) means that the nozzle body 150 is either fixedly or removably attached to the integrated air cap/nozzle 140, such that the nozzle body 150 is capable of remaining attached to the body of the integrated air cap/nozzle 140 when the integrated air cap/nozzle 140 is detached from the barrel or another component of the spray gun platform. In some embodiments, it may be preferred that the junction between the first front wall portion 160*a* and the second front wall portion 160*b* around the periphery of the aperture 149 be air-tight, i.e., that air cannot pass through the junction during normal operation of the integrated air cap/nozzle 140.

As assembled, the composite front wall (a composite of portions 160*a* and 160*b*) further includes a nozzle aperture front wall portion 160*a*. The nozzle aperture is larger than the nozzle outlet end 156 of the nozzle body 150 and the nozzle outlet end 156 of the nozzle body 150 is located in the nozzle aperture such that a gap is found between the nozzle aperture and the nozzle outlet end 156 of the nozzle body 150. That gap between the nozzle aperture and the nozzle outlet end 156 forms the center air outlet 154 in the integrated air cap/nozzle 140. Air entering the center air chamber from the liquid spray gun platform passes through the center air outlet 154 around the nozzle outlet end 156 of the nozzle body 150. Because of the arrangement of the composite front wall (formed by portions 160*a* and 160*b*) and the nozzle body 150, the nozzle passage in the nozzle body 150 and the center air chamber are independent of each other such that liquid exiting the nozzle passage through the liquid nozzle opening 152 and air exiting the center air chamber through the center air outlet 154 are preferably separated from each other until they exit their respective orifices.

Forming the nozzle body 150 separately from the remainder of the integrated air cap/nozzle 140 and subsequently attaching the nozzle body 150 to the remainder of the integrated air cap/nozzle 140 may offer potential benefits. In such an embodiment, manufacturing of the integrated air cap/nozzle 140 may be simplified because the relatively complex geometries of the various components of the integrated air cap/nozzle 140 may, in some instances, be difficult to manufacture as one unitary part. In some embodiments, the nozzle body 150 may be colored differently from the remainder of the integrated air cap/nozzle 140, if formed separately. Different colors can be used to designate, for example, nozzle bodies having different configurations, such as the size of the liquid nozzle opening and/or the size of the center air opening. However, in other exemplary embodiments, the nozzle body may be formed integrally with other components or the remainder of the integrated air cap/nozzle 140, such as by injection molding or machining.

Figure 17:
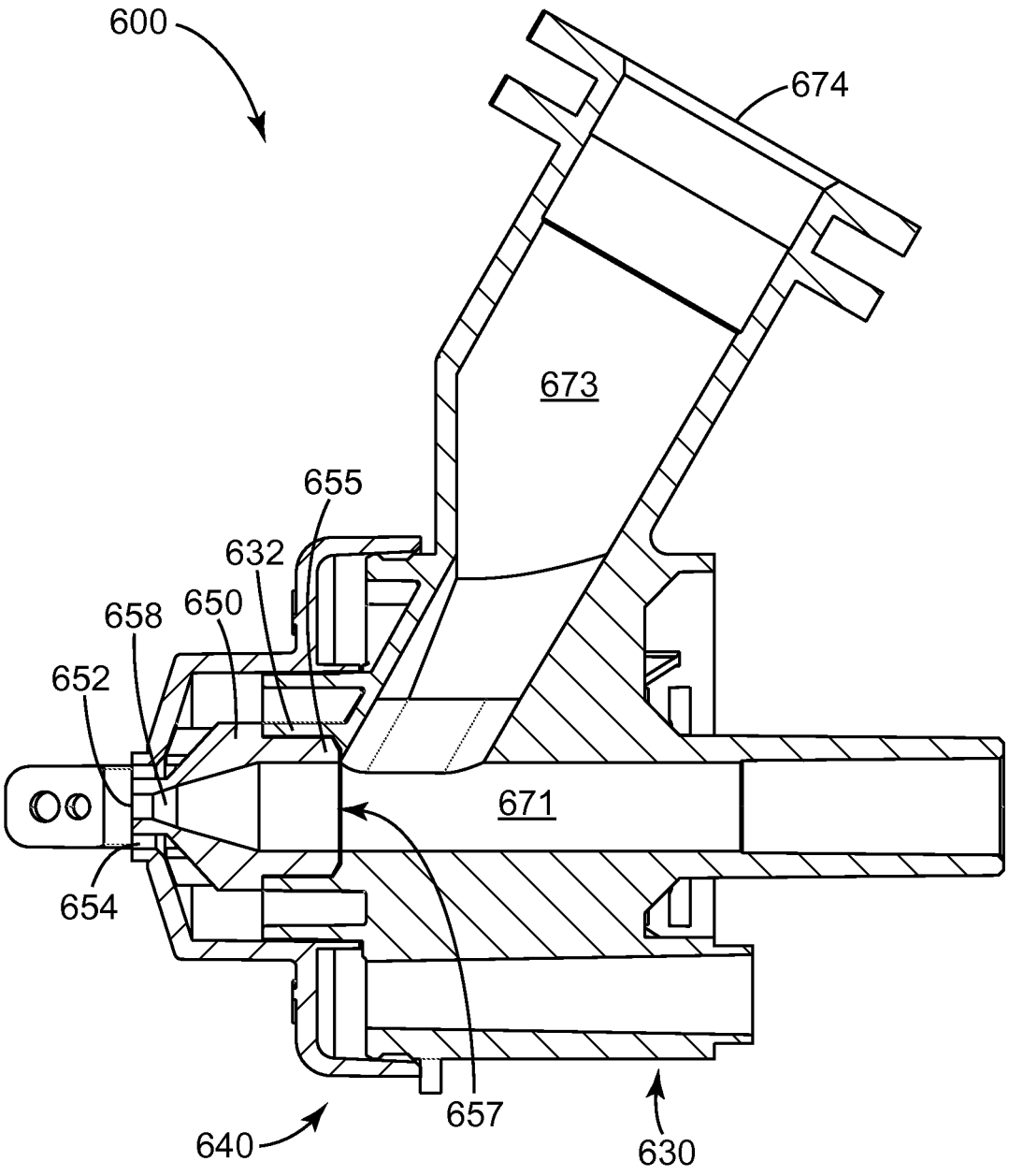
FIG. 17 is a cross-sectional view of another exemplary spray head assembly according to the present disclosure.
Figure 18:
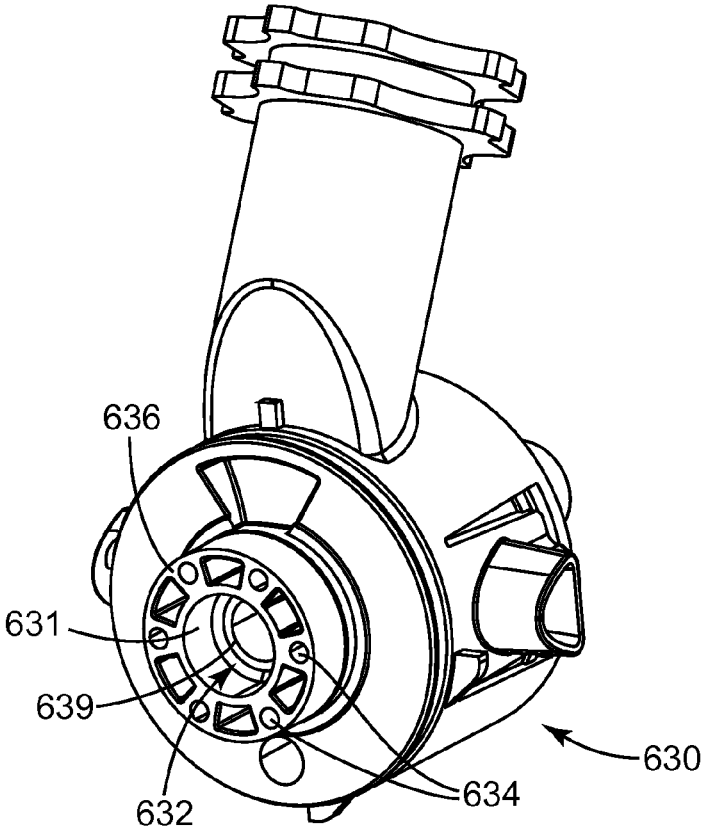
FIG. 18 is a perspective view of the barrel of the exemplary spray head assembly shown in FIG. 17.
Figure 19:
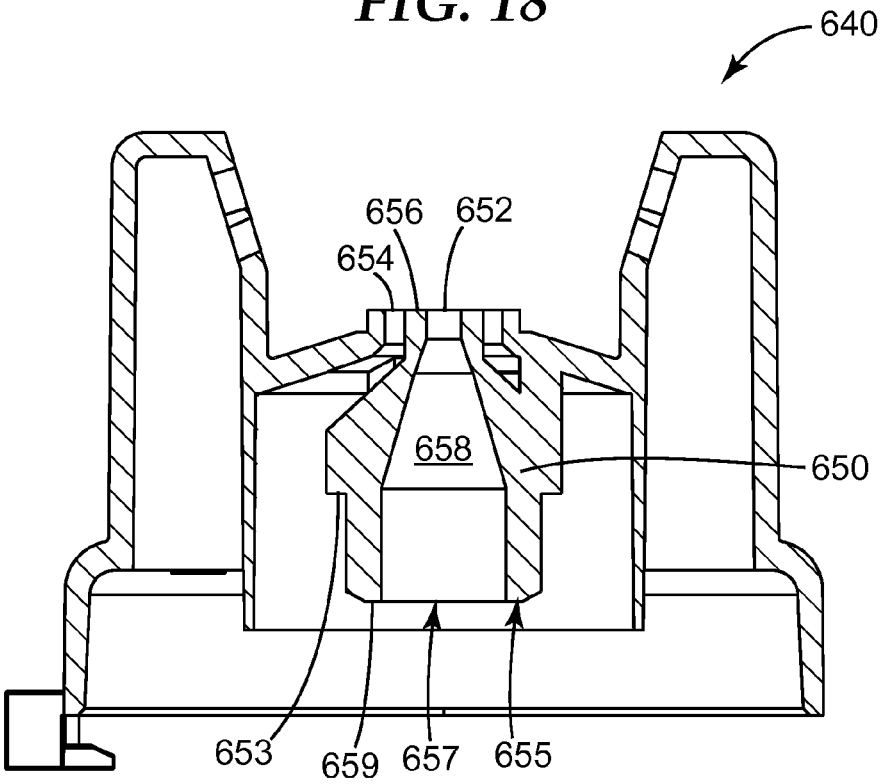
FIG. 19 is a cross-sectional view of the integrated cap/nozzle of the exemplary spray head assembly shown in FIG. 18.

Other exemplary configurations of the nozzle body and nozzle port according to the present disclosure are illustrated in reference to FIGS. 17-19. FIGS. 17-19 show a spray head assembly 600 including a barrel 630 and an integrated air cap/nozzle 640 that is removably attached to the barrel 630. The integrated air cap/nozzle 640 includes a nozzle body 650. The nozzle body 650 defines a liquid nozzle opening 652 and a center air outlet 654. In accordance with the present disclosure, the nozzle body 650 is a part of the cap body of the air cap/nozzle 640, such that the entire construction could be removed from the barrel 630 as mentioned above, preferably without using any tools. The nozzle body 650 includes an inlet end 655 and a nozzle outlet end 656.

The liquid nozzle opening 652 is formed in the nozzle outlet end 656 of the nozzle body 650, while a nozzle body inlet 657 is also formed in the nozzle body 650 at the opposite end of a nozzle passage 658 (see, e.g., FIG. 19) that connects the nozzle body inlet 657 to the liquid nozzle opening 652. As a result, the nozzle passage 658 can be described as extending through the nozzle body 650 from the nozzle body inlet 657 to the liquid nozzle opening 652, such that liquid entering the nozzle passage 658 through the nozzle body inlet 657 leaves the nozzle body 650 through the liquid nozzle opening 652 after passing through the nozzle passage 658. The depicted nozzle passage 658 is characterized by a smaller diameter proximate the liquid nozzle outlet end 656 and a larger diameter proximate a nozzle body inlet 657. In the illustrated embodiment, a portion of the nozzle passage 658 is tapered such that the cross-sectional area of the nozzle passage 658 decreases when moving through the nozzle passage 658 from the nozzle body inlet 657 towards the liquid nozzle opening 652, for example, to form a frusto-conically shaped section. Further, one or both of the nozzle body inlet end 655 and the nozzle body outlet end 656 ends may include a cylindrically shaped section. However, the nozzle passages in other nozzle bodies may alternatively have a constant cross-sectional area, or may take any other selected shape.

The barrel 630 includes a liquid passageway 671 that terminates in the nozzle port 632 through which the liquid to be sprayed exits the barrel 630 and enters the nozzle passage 658 of nozzle body 650 (see, e.g., FIG. 17). The openings 634 in the barrel 630 deliver the center air exiting the barrel cavity (not shown) to a nozzle cavity (not shown) formed between the integrated air cap/nozzle 640 and the front wall 636 of the barrel 630. In this exemplary embodiment, the nozzle port 632 includes a concave structure. Particularly, the nozzle port 632 includes a sealing structure 639 (configured to form a sealed connection with the nozzle inlet end 655) that is recessed with respect to the front wall 636 of the barrel 630. The concave structure of an exemplary nozzle port 632 may include one or more cylindrically shaped sections (e.g., 631), one or more frusto-conically shaped sections, or both, which in some embodiments may be recessed with respect to the front wall 636 of the barrel 630.

As shown in FIG. 17, in the assembled spray head assembly 600, at least a portion of the nozzle body 650 is positioned within a recess of the nozzle port 632. For example, the nozzle body inlet end 655 may be inserted into a recess formed in the front wall 636 of the barrel 630, such that the nozzle sealing structure 659 (e.g., a sealing surface) may reach and seal against the sealing structure 639 (which may also be a sealing surface) of the nozzle port 632. When the integrated cap/nozzle 640 and the barrel 630 are connected, a sealing surface or structure 639 of the nozzle port 632 abuts the nozzle sealing surface or structure 659 and the nozzle body 650 forms a tight seal with the nozzle port 632. Thus, liquid exiting the nozzle port 632 enters the nozzle passage 658 in the nozzle 650 without leaking into the center air chamber under normal operating conditions. One or both sealing structures may, in some embodiments, include a gasket, O-ring or other sealing element to assist in formation of the seal. The ledge 653 of the nozzle body 650 may also abut a structure of the nozzle port 632, such as the front wall or a portion of the front wall of the barrel 636.

Those of ordinary skill in the art will readily appreciate that yet other suitable configurations of a nozzle body and nozzle port are within the scope of the present disclosure. For example, although projecting and concave configurations of nozzle ports have been shown and described so far, a nozzle port that is substantially level with the front wall 36, 636 of the barrel 30, 630 is also within the scope of the present disclosure.

The integrated air cap/nozzles described herein may be manufactured of any suitable material or combination of materials and by any manufacturing technique or techniques suitable for the selected material or materials, e.g., molding, casting, machining, direct digital manufacturing, etc.). In some embodiments, the integrated air cap/nozzles may be molded or otherwise formed as an integral, one-piece component which requires no assembly to provide a completed integrated air cap/nozzle, while in other embodiments, the integrated air cap/nozzle may be formed as a multi-piece assembly (e.g., two, three, or more pieces) that can be assembled to form an integrated air cap/nozzle that includes the features of integrated air cap/nozzles as described herein. Some examples of potentially suitable materials may include, e.g., metals, metal alloys, polymers (e.g., polyurethanes, polyolefins (e.g., polypropylenes), polyamides (e.g., nylons including amorphous nylons), polyesters, fluoropolymers, and polycarbonates), and others. If polymeric materials are used to construct the integrated air cap/nozzles, the polymeric materials may include any suitable additives, fillers, etc., such as, e.g., glass fiber, glass or polymeric bubbles or microbubbles, electrically conductive and/or static dissipating materials such as, e.g., finely divided metals, metal salts, metal oxides, carbon or graphite, etc. Selection of the materials used in the integrated air cap/nozzles described herein may preferably be based at least in part on the compatibility of the selected materials with the materials to be sprayed (e.g., solvent resistance and other characteristics may need to be considered when selecting the materials used to construct the integrated air cap/nozzles).

Although the integrated air cap/nozzles may be provided alone (e.g., without a barrel or other components) and the spray head assemblies described herein may be provided with an integrated air cap/nozzle and barrel that are either pre-assembled or that can be assembled to form a spray head assembly, in some instances two or more integrated air cap/nozzles may be provided as a part of kit that may be supplied to a party that already has the other components of a spray head assembly (e.g., a barrel) or the kit may include one or more barrels and/or one or more integrated air cap/nozzles.

As discussed herein, the integrated air cap/nozzles can, in some embodiments, be removed from the spray head assemblies without requiring that the integrated air cap/nozzle and/or the barrel be removed from the spray gun. The integrated air cap/nozzles described herein may be removed for cleaning and/or replacement. If multiple integrated air cap/nozzles are provided in a kit, the different integrated air cap/nozzles may or may not include different features and/or characteristics. In various embodiments of the kits, for example, at least two of the integrated air cap/nozzles may have center air outlets having different dimensions (e.g., different diameters, different cross-sectional areas, at least two of the integrated air cap/nozzles may have liquid nozzle openings having different dimensions (e.g., different diameters, different cross-sectional areas, etc.), at least two integrated air cap/nozzles of the plurality of integrated air cap/nozzles may have liquid nozzle openings having different dimensions and center air outlets having different dimensions. In some embodiments, color-coding may be used to identify integrated air cap/nozzles having different characteristics.

Figure 9:
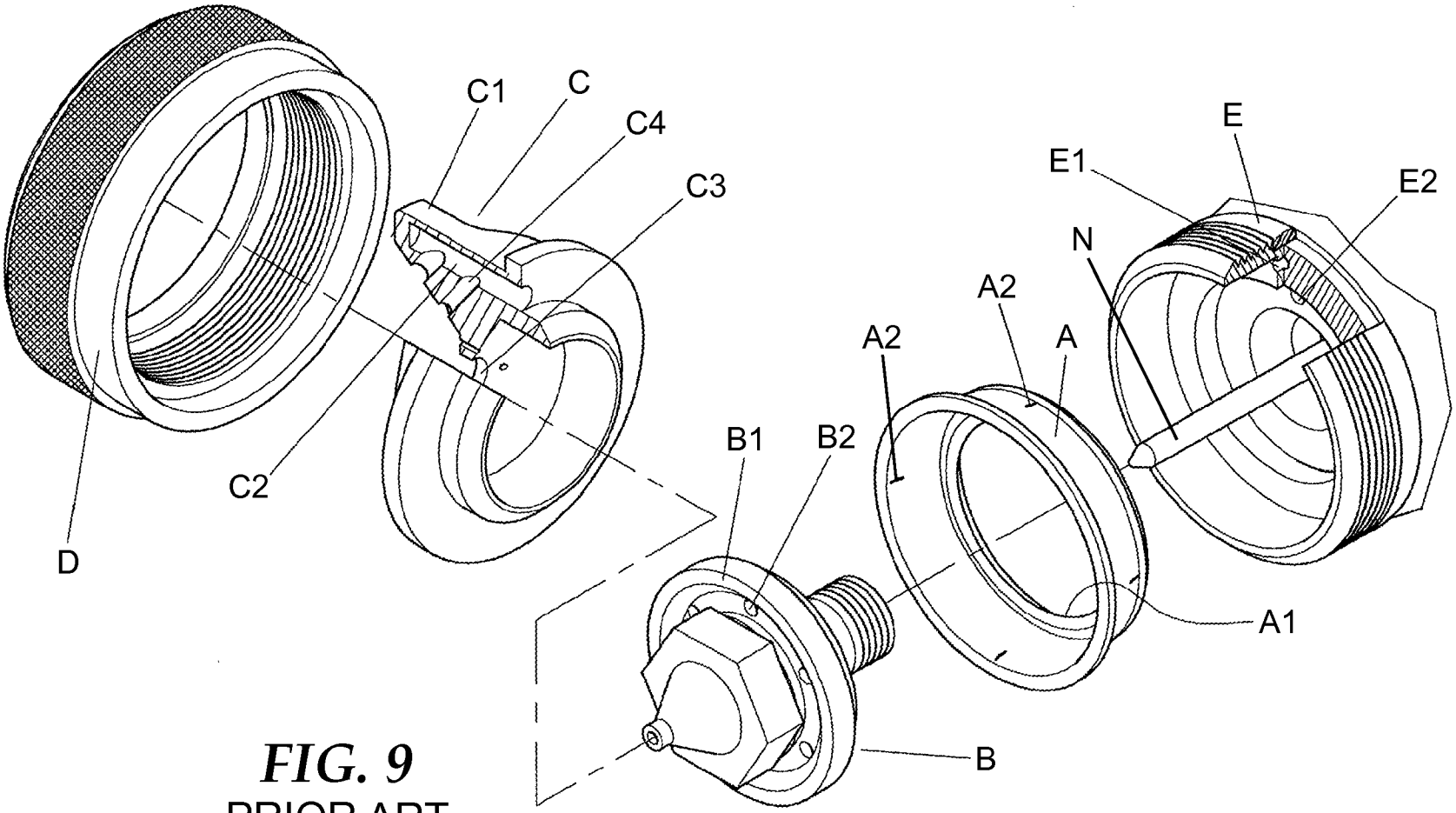
FIG. 9 PRIOR ART
FIG. 9 is an exploded view of a portion of one embodiment of a prior art spray head assembly in which selected portions have been removed to illustrate certain features more clearly.
Figure 10:
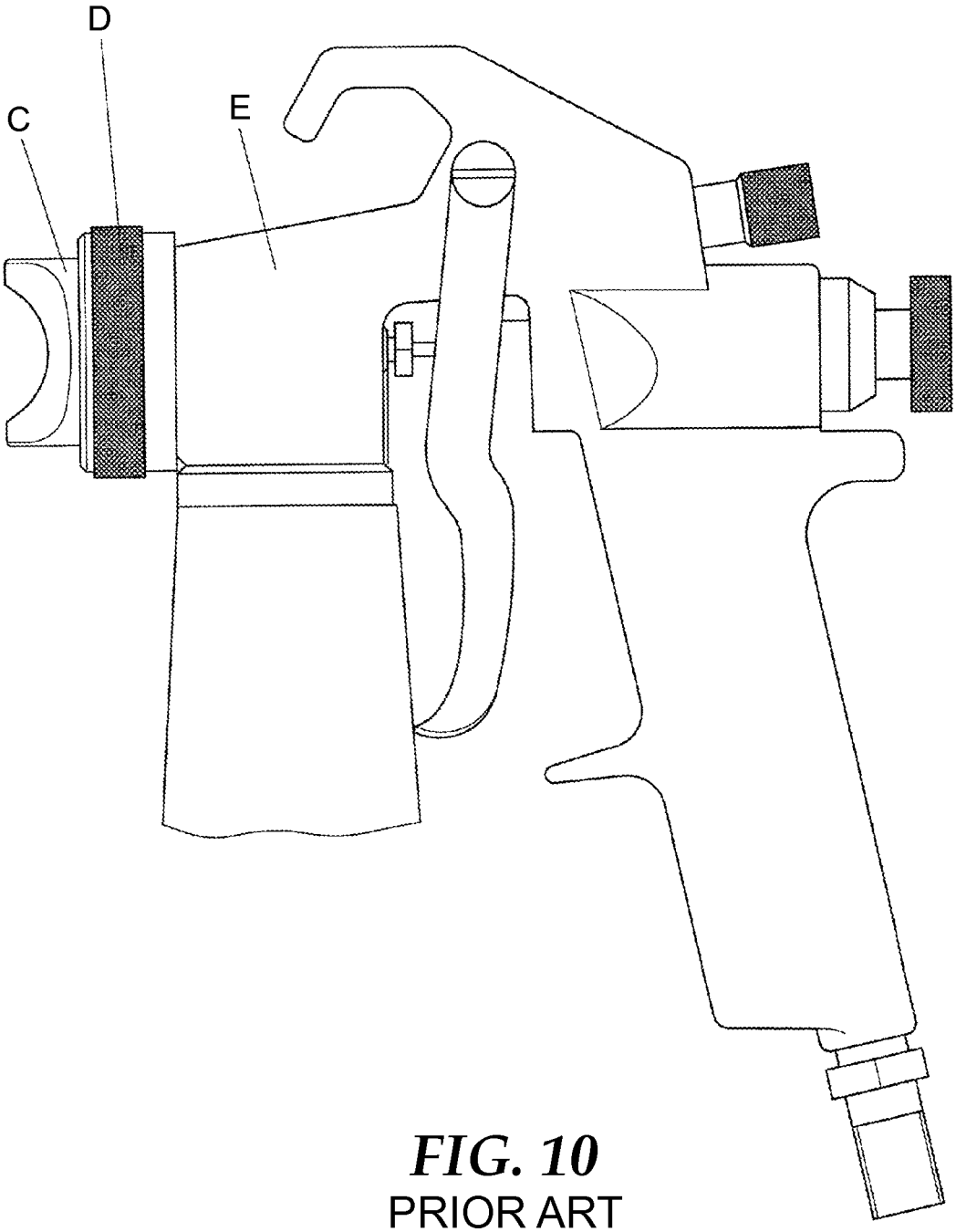
FIG. 10 PRIOR ART
FIG. 10 is a side view of a prior art spray gun with the spray head assembly of FIG. 9 mounted thereon.
Figure 11:
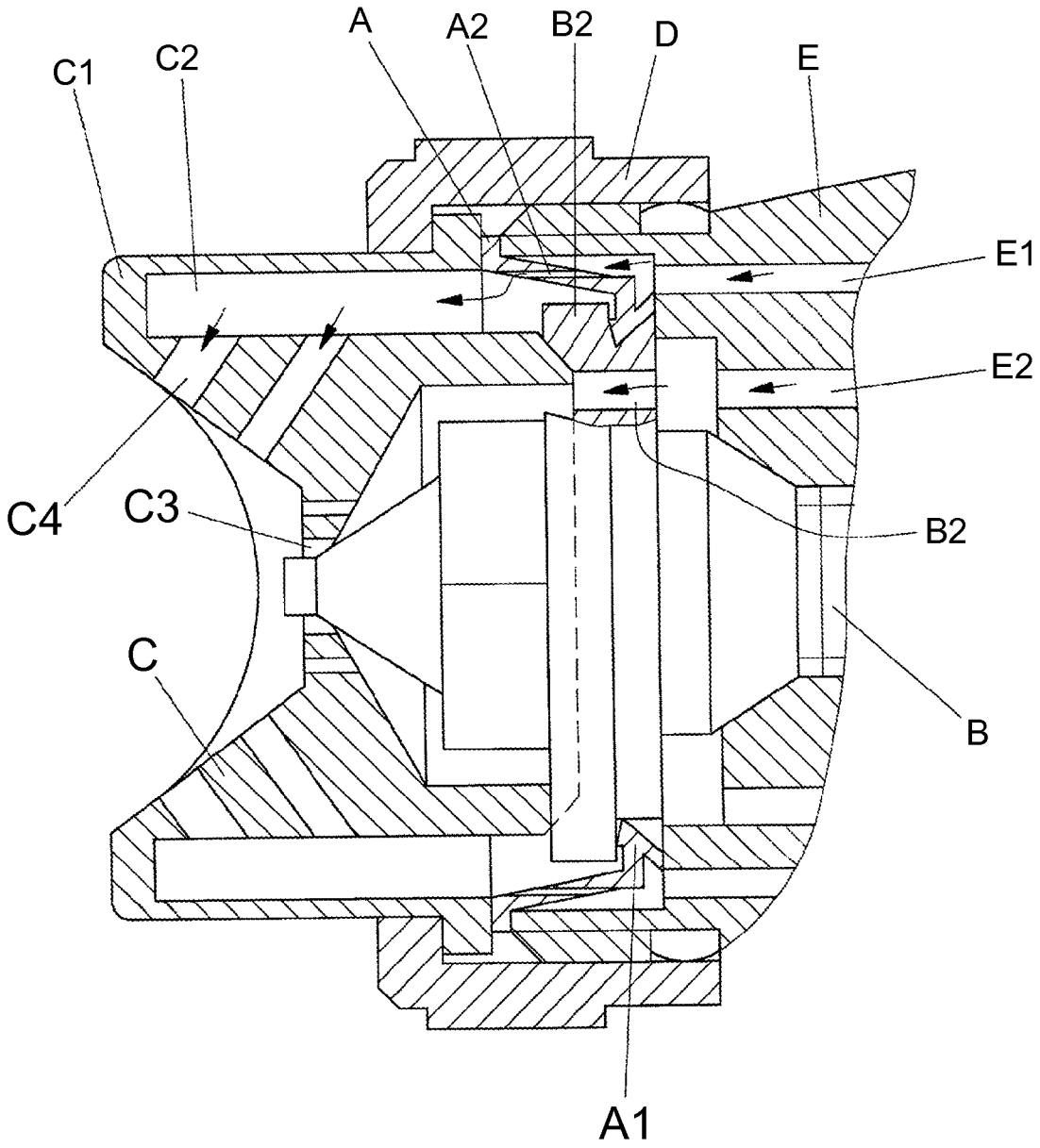
FIG. 11 PRIOR ART
FIG. 11 is an enlarged vertical cross-sectional view of a portion the spray head assembly as depicted in FIG. 10.

Another illustrative alternative embodiment of a spray head assembly that includes a removable integrated air cap/nozzle as described herein is depicted in connection with FIGS. 9-14. In particular, FIGS. 9-11 depict a conventional liquid spray gun that includes a ring A, a nozzle B, an air cap C, and a retaining ring D. The nozzle B is located at the center of the front end of the spray gun. The spray gun E includes openings E1 and E2 that supply center air and fan air. The nozzle B includes a circular rim B1 having air holes B2 formed therein. The ring A is in a bowl shape having a rim A1 at the narrow side with openings A2. The air cap C includes a pair of air horns C1 that include air passages C2 and openings C4. The air cap C also includes a nozzle opening C3 at its center portion, and a pair of air holes C4 at respective sides.

Assembly of the spray gun with the spray head assembly involves attaching the nozzle B to the spray gun platform E using the threaded connector which threads into a complementary bore in the gun platform E. The circular rim B1 of the nozzle B holds the ring A in place on the spray gun platform E. With the nozzle B in place, the air cap is placed over the nozzle and held in place using the retaining ring D, which threads onto the spray gun platform E using the depicted threads.

During operation, pressurized air passes through the openings E1 and E2 of the spray gun E. The air passing from opening E1 provides the fan air as it passes through openings A2 in the ring A, where it then passes into the air passages C2 in the air horns C1 for delivery through the openings C4. The air passing from the opening E2 passes through openings B2 in the circular rim B1 of nozzle B and then proceeds around nozzle B until it exits through C3 around the nozzle B. In essence, the circular rim B1 of the nozzle B and the ring A define a barrel cavity in the spray gun E.

Because the nozzle B is held in place behind the air cap C and the nozzle opening C3 in the air cap C is used to form the center air outlet around the nozzle B, removal of the nozzle B for cleaning and/or replacement requires removal of the air cap C.

Figure 12:
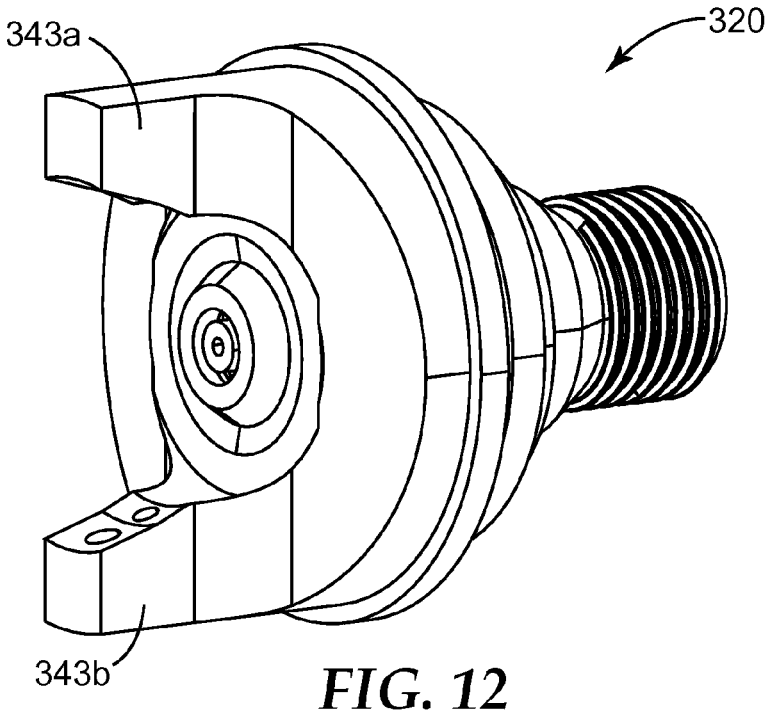
FIG. 12 is a perspective view of another illustrative embodiment of a spray head assembly as described herein.
Figure 13:
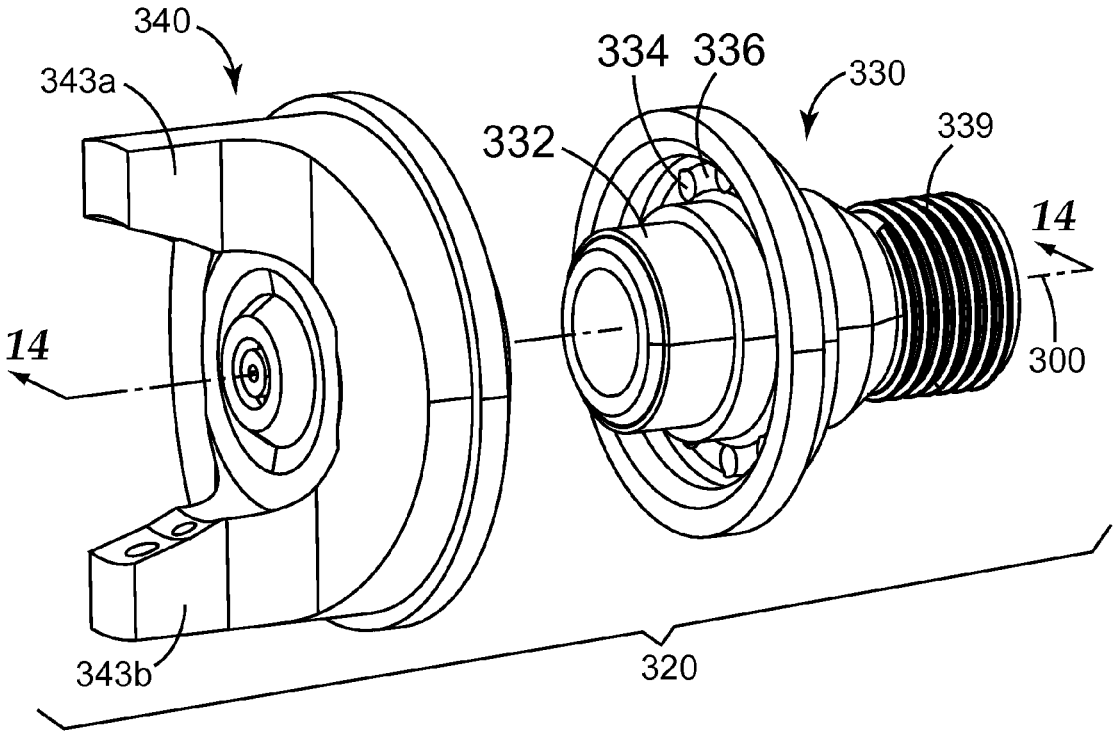
FIG. 13 is an exploded perspective view of the spray head assembly of FIG. 12.
Figure 14:
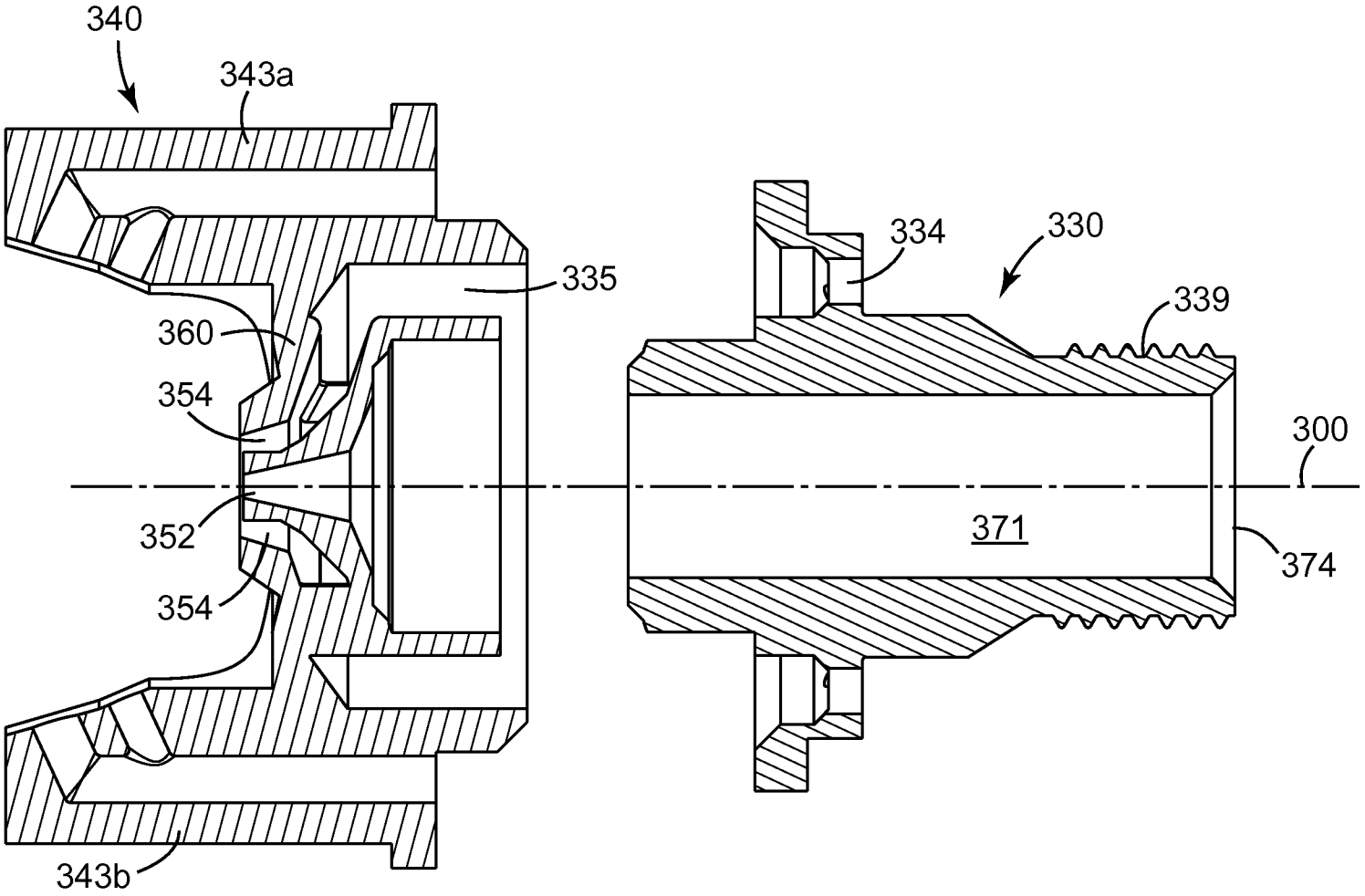
FIG. 14 is a cross-sectional view of the spray head assembly of FIG. 13 taken along line 14-14 in FIG. 1.

The spray head assembly components depicted in FIGS. 12-14 can be used to retrofit a conventional spray gun such as that depicted in FIGS. 9-11 and similar guns. In particular, the spray head assembly kit 320 depicted in FIGS. 12-14 includes a barrel adaptor 330 that is adapted for attachment to a liquid spray gun platform, an integrated air cap/nozzle 340 adapted for attachment over the barrel adaptor 330. The barrel adaptor 330 and the integrated air cap/nozzle 340 of the spray head assembly 320 preferably combine to form cavities that deliver the center air and the fan air in a substantially isolated manner through the spray head assembly.

The barrel adaptor 330 in the embodiment of FIGS. 12-14 includes a threaded connector 339 that is adapted to attach to conventional liquid spray guns such as, e.g., those described in U.S. Pat. No. 6,793,155 (Huang); etc. As one example, the spray head assembly 320 may be used in conjunction with, e.g., a DeVilbiss GTI spray gun (available from Illinois Tool Works, Inc.). Thus, barrel adaptor 330 enables a user to retrofit a traditional spray gun with integrated air cap/nozzles according to the present disclosure.

In the embodiment depicted in FIGS. 12-14, the barrel adaptor 330 includes features that may replace both the nozzle B and the ring A of the prior art spray head assembly depicted in FIGS. 9-11—except that the exemplary barrel adaptor 330 does not include the actual liquid nozzle opening through which liquid being delivered by the spray gun passes. Rather, the integrated air cap/nozzle 340 includes the liquid nozzle opening 352 and is positioned over a liquid nozzle port 332 on the barrel adaptor 330 and liquid being sprayed exits from the spray head assembly 320 through the liquid nozzle opening 352. As described herein, the integrated air cap/nozzle 340 is removable from the barrel adaptor 330 for cleaning and/or replacement. In the depicted embodiment, the integrated air cap/nozzle 340 may be retained on a spray gun using a collar or ring such as, e.g., the retaining ring D depicted in the prior art spray gun of FIGS. 9-11. Any other suitable connection could be used, however, to hold the integrated air cap/nozzle 340 in place on a spray gun. The barrel adaptor 330 includes features that define a liquid passageway 371 that terminates in the liquid nozzle port 332 through which the liquid to be sprayed exits the barrel adaptor 330 and enters the nozzle body 350 of the integrated air cap/nozzle 340. Liquid enters the liquid passageway 371 in the barrel adaptor 330 through liquid port 374. The liquid passageway 371 defined in the barrel adaptor 330 is preferably isolated from the other features in the barrel. The liquid passageway 371 may preferably be sized to receive a needle (see, e.g., needle 14 in FIG. 1) that is capable of closing the liquid nozzle opening 352 when advanced towards the liquid nozzle opening 352 and opening the liquid nozzle opening 352 when retracted in the rearward direction away from the liquid nozzle opening 352.

The openings 334 in the barrel adaptor 330 deliver the center air exiting a barrel cavity in the spray gun platform (that is defined, at least in part, by the barrel adaptor 330) to a nozzle cavity 335 formed between the integrated air cap/nozzle 340 and the front wall 336 of the barrel adaptor 330. Air entering the nozzle cavity 335 flows through the nozzle cavity 335 until it exits the nozzle cavity 335 though a center air outlet 354 formed around the nozzle body 350. In the depicted embodiment, the nozzle cavity 335 forms at least a portion of what can be characterized as the center air chamber of the spray head assembly 320, with the center air chamber terminating at the center air outlet 354 formed in the integrated air cap/nozzle 340. The center air outlet 354 preferably surrounds the liquid nozzle opening 352 such that the center air passing through the center air outlet 354 can form the liquid passing through the liquid nozzle opening 352 into a generally conical stream.

The air cap 340 defines a nozzle cavity 335 at the front wall 336 of the barrel adaptor 330. Although not shown in the cross-sectional view of FIG. 13, the integrated air cap/nozzle 340 may also define optional cavities that, taken together, make up a portion of an optional fan air chamber in the spray head assembly 320. Any such fan air chamber would extend into the optional pair of air horns 343*a* and 343*b* and fan air exiting from such openings could be used to change the shape of the stream of liquid to form a desired spray pattern as described herein and in other documents identified herein. Air caps having fan air chamber passages and air horns are described herein in connection with the embodiment of FIGS. 1-7, in the prior art spray head assembly of FIGS. 9-11, and in at least some of the patent documents identified above.

The removable integrated air cap/nozzles and spray head assemblies described herein may be used with a variety of liquid spray guns and spray gun platforms. In some embodiments, the liquid spray guns and spray gun platforms may be commonly referred to as gravity-fed spray guns (where the liquid to be sprayed is fed under gravity to the spray head assembly), siphon-fed spray guns (where the liquid to be sprayed is siphoned into the spray head assembly from a reservoir), and/or pressure-fed spray guns (where the liquid to be sprayed is fed under pressure from the reservoir into the spray head assembly). Further, auxiliary components that may be used in connection with the spray guns, spray gun platforms, and spray head assemblies discussed herein, and their respective methods of use, may be described in more detail in, e.g., U.S. Pat. No. 6,820,824 (Joseph et al.); U.S. Pat. No. 6,971,590 (Blette et al.); U.S. Pat. No. 7,032,839 (Blette et al.); U.S. Pat. No. 7,201,336 (Blette et al.); U.S. Pat. No. 7,484,676 (Blette et al.), and in U.S. Patent Application Publication Nos. 2004/0140373 (Joseph et al.); 2006/0065761 (Joseph et al.) and 2006/0102550 (Joseph et al.), etc.

Figure 20:
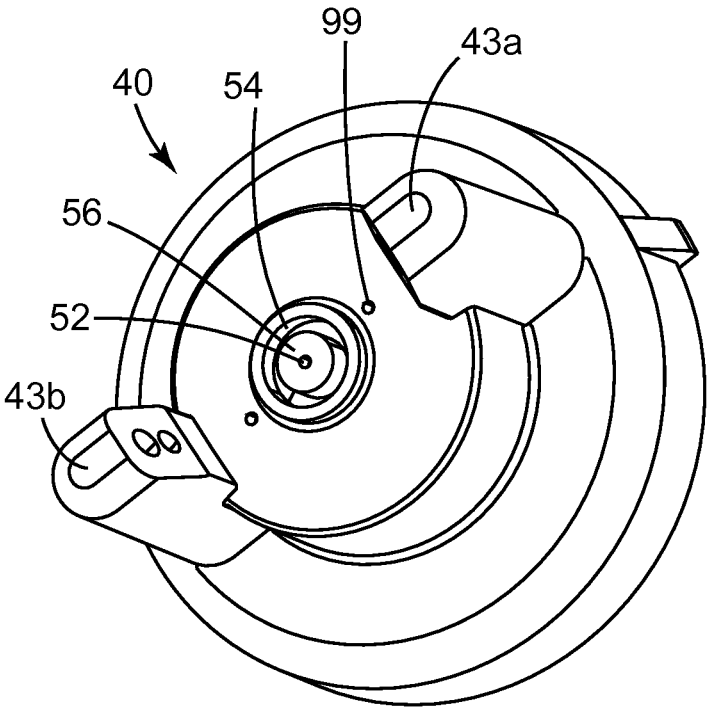
FIGS. 20 and 21 are isometric views of alternative embodiments of the integrated air cap/nozzle of FIG. 6.
Figure 21:
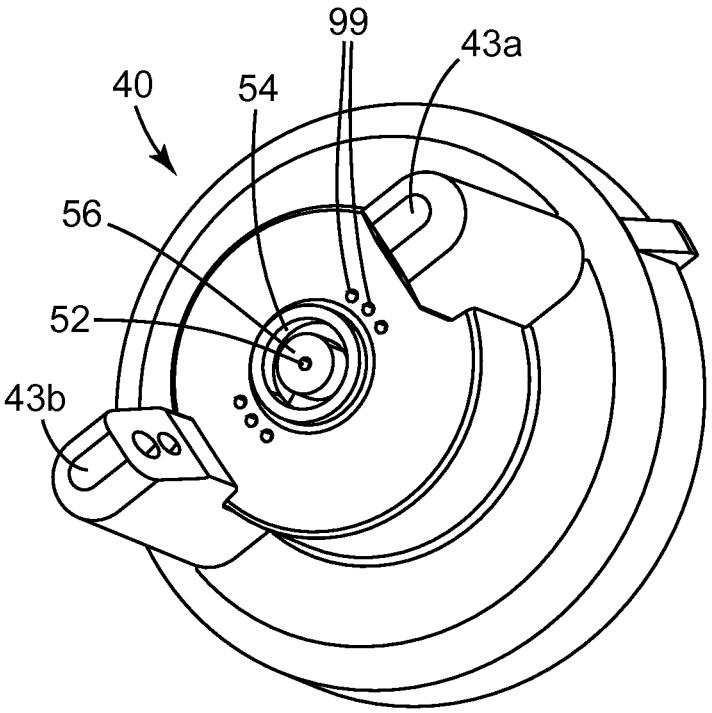
Figure 22:
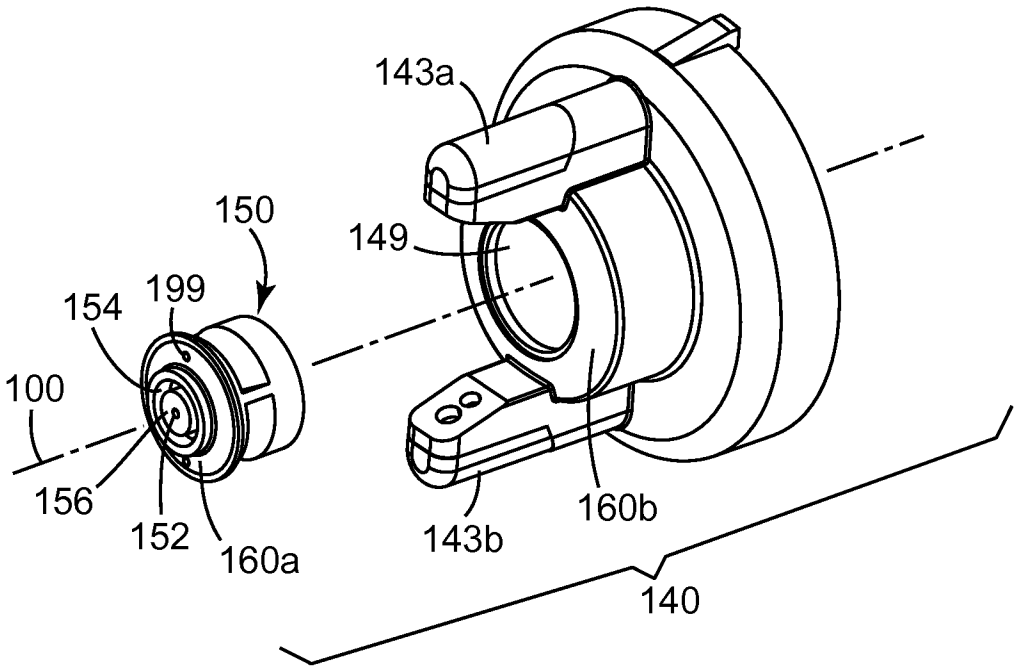
FIG. 22 is an isometric view of an alternative embodiment of the integrated air cap/nozzle of FIG. 8.
Figure 23A:
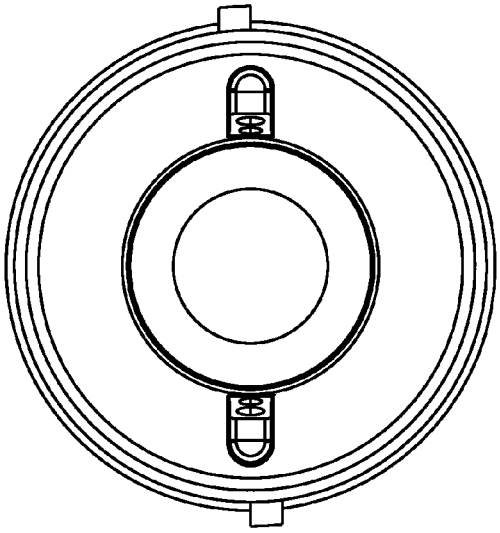
FIG. 23A is a rear view of an ornamental design for a portion of an integrated air cap/nozzle as depicted in FIG. 8.
Figure 23B:
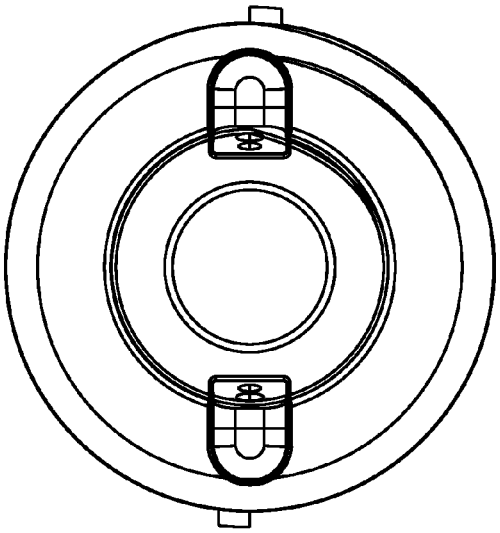
FIG. 23B is a front view of an ornamental design for a portion of an integrated air cap/nozzle as depicted in FIG. 8.
Figure 23C:
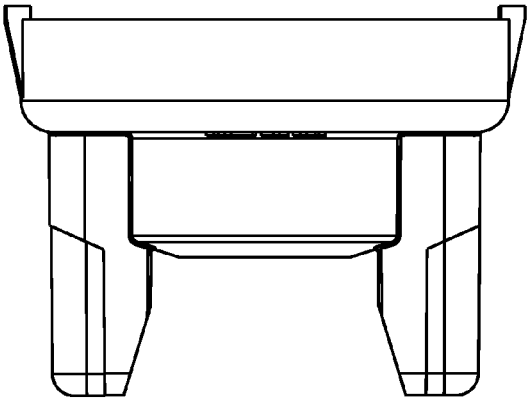
FIG. 23C is a top view of an ornamental design for a portion of an integrated air cap/nozzle as depicted in FIG. 8.
Figure 23D:
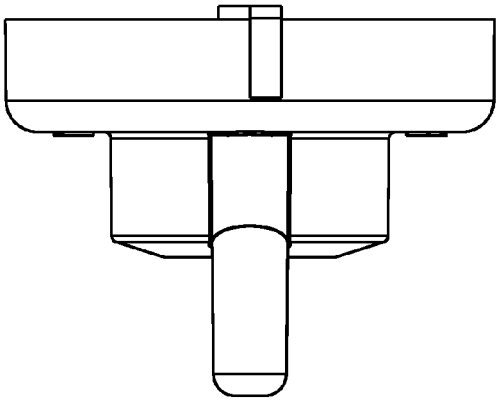
FIG. 23D is a side view of an ornamental design for a portion of an integrated air cap/nozzle as depicted in FIG. 8.
Figure 24A:
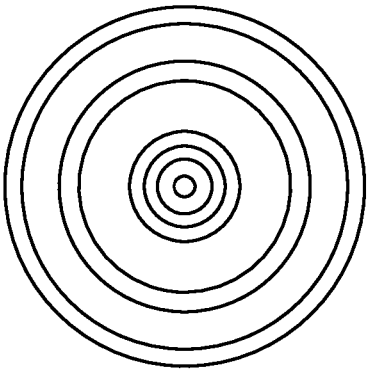
FIG. 24A is a rear view of an ornamental design for a nozzle body as depicted in FIG. 8.
Figure 24B:
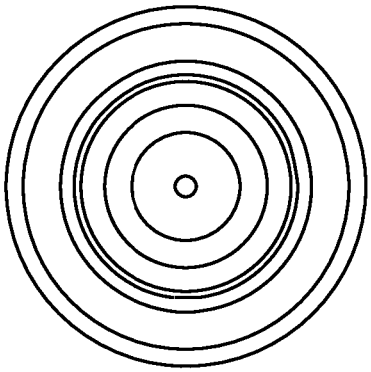
FIG. 24B is a front view of an ornamental design for a nozzle body as depicted in FIG. 8.
Figure 24C:
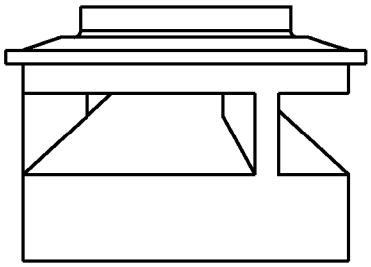
FIG. 24C is a top view of an ornamental design for a nozzle body as depicted in FIG. 8.
Figure 24D:
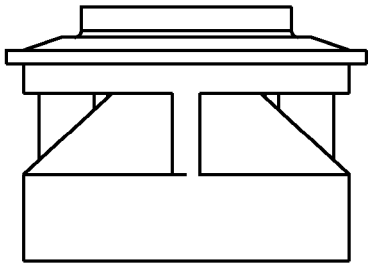
FIG. 24D is a first side view of an ornamental design for a nozzle body as depicted in FIG. 8.
Figure 24E:
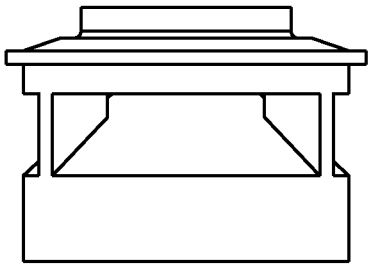
FIG. 24E is a second side view of an ornamental design for a nozzle body as depicted in FIG. 8.

FIGS. 20-22 depict alternative embodiments of the integrated air cap/nozzle 40 or separate nozzle body 150 shown and described above with reference to FIGS. 6 and 8. In these alternative embodiments, at least one pair of auxiliary air apertures 99/199 is provided in the front wall of the integrated air cap/nozzle (or in some embodiments, the front wall of the nozzle body) straddling the center air outlet 54/154 and adapted for fluid communication with the center air chamber. Two, three, four, or more pairs of auxiliary air apertures may be provided in some embodiments. Pressurized air escaping through such auxiliary air apertures 99/199 can impinge upon air streams leaving the air horns 43*a*/43*b* (343*a*/343*b*) to alter the interaction of the shaping air with the atomized liquid. An example of circular auxiliary air orifices provided in metal spray gun components, along with a description of their function, can be found in U.S. Pat. No. 5,456,414 to Burns et al. (see reference numbers 37 and 38 therein), the disclosure of which is incorporated by reference herein in its entirety.

Typically, such auxiliary air apertures 99/199 are symmetrically disposed about the center air outlet 54/154. The auxiliary air apertures 99/199 may be provided in the form of circular holes, square holes, triangular holes, elongate slots, or in any other aperture shape, including combinations of shapes, adapted to achieve the function described above. The size of the auxiliary air apertures 99/199 is typically relatively small to permit proper shaping performance and to avoid excess use of air. In some embodiments, the effective diameter of each auxiliary air aperture 99/199 lies in a range from about 0.025 inch (0.0635 cm) to about 0.040 inch (0.102 cm). "Effective diameter" as used herein means the dimension of the smallest path across the cross section of the aperture as viewed along the axis extending through the liquid nozzle opening. In some embodiments, the open area of each auxiliary air aperture 99/199 lies in a range from about 0.00049 $inch^2$ ($0.00316\ cm^2$) to about 0.00125 $inch^2$ ($0.00806\ cm^2$). It should be understood that values of effective diameter and open area outside of the above ranges are also within the scope of the present disclosure, and that such dimensions will be chosen to suit the particular spray gun application (e.g., differing liquid viscosities, etc.) and overall spray gun geometry.

In some embodiments, the integrated air cap/nozzle 40 or separate nozzle body 150 are molded polymeric components comprising polymeric materials as described elsewhere herein. As reported in Burns et al., circular auxiliary air orifices have been previously employed for spray pattern shaping in traditional, and relatively expensive, metal spray gun components. Creation of such features in metal components typically involves operations such as precision machining or laser drilling of the part to create the desired holes. Such operations would tend to add undesirable expense and manufacturing time in the construction of molded polymeric components that may be intended to be less inexpensive and often disposable. In some instances, and depending on the type of polymeric material itself (e.g., commodity polymers versus engineering polymers), the ability to precisely machine or laser drill polymeric components so as to achieve such auxiliary air apertures may be somewhat limited. However, by incorporating auxiliary air apertures 99/199 into polymeric integrated air cap/nozzle 40 or separate nozzle body 150 (i.e., the moldable polymeric embodiments as described herein), such features may be directly molded into the parts in a single molding operation. Owing to the small size and features of the part in general, it may be particularly desirable to use micro and miniature injections molding techniques to mold auxiliary air apertures 99/199 into a nozzle body 150 as described herein.

The complete disclosure of the patents, patent documents, and publications cited herein are incorporated by reference in their entirety (to the extent that those teachings do not conflict with the explicit descriptions found herein) as if each were individually incorporated.

Illustrative embodiments of liquid spray guns, liquid spray gun platforms, and liquid spray head assemblies and methods of using them are discussed and reference has been made to possible variations. These and other variations, combinations, and modifications will be apparent to those skilled in the art without departing from the scope of the invention, and it should be understood that this invention is not limited to the illustrative embodiments set forth herein. Rather, the invention is limited only by the claims provided below, and equivalents thereof.

What is claimed is:

1. An integrated air cap/nozzle for a liquid spray gun, wherein the integrated air cap/nozzle comprises:

a cap body comprising:

a nozzle body comprising a nozzle aperture, a nozzle outlet end located within the nozzle aperture, and a liquid nozzle opening located within the nozzle outlet end through which liquid exits during operation of the liquid spray gun; and a center air outlet located in a gap defined between the nozzle aperture and the nozzle outlet end, through which center air discharges when a liquid is sprayed through the liquid nozzle opening;

wherein the liquid nozzle opening and the center air outlet are formed in a front wall of the cap body.

2. An integrated air cap/nozzle according to claim 1, wherein the integrated air cap/nozzle is removably attached to a liquid spray gun.

3. An integrated air cap/nozzle according to claim 1, wherein the cap body further comprises a liquid port in fluid communication with the nozzle body.

4. An integrated air cap/nozzle according to claim 1, wherein the nozzle body is attached to the front wall of the integrated air cap/nozzle by one or more support members extending from the nozzle body to the front wall.

5. An integrated air cap/nozzle according to claim 1, wherein the gap formed by the nozzle outlet end and the nozzle aperture comprises an annular gap.

6. An integrated air cap/nozzle according to claim 1 further comprising a barrel comprising a nozzle port, wherein the nozzle body comprises a nozzle sealing structure proximate a nozzle body inlet, wherein the nozzle sealing structure forms a liquid tight seal with the nozzle port on the barrel when the integrated air cap/nozzle is attached to the barrel.

7. An integrated air cap/nozzle according to claim 1, wherein the nozzle body and the front wall are formed as an integral, one-piece component.

8. An integrated air cap/nozzle according to claim 1, wherein the nozzle outlet end, the liquid nozzle opening, and the center air outlet are shaped to direct air under greater than atmospheric pressure against liquid flowing out of the liquid nozzle opening.

9. An integrated air cap/nozzle according to claim 1 further comprising a barrel, and wherein the front wall further comprises a nozzle aperture, wherein the integrated air cap/nozzle comprises two air horns, and wherein the integrated air cap/nozzle, when attached to the barrel, also defines a fan control air chamber that extends from an inlet end of a fan air barrel passage formed in the barrel to apertures located on the air horns projecting past the nozzle aperture, wherein the apertures in the air horns are located on opposite sides of an axis extending through the liquid nozzle opening such that air flowing out of the fan control air chamber through the apertures on the air horns under greater than atmospheric pressure flows against opposite sides of a stream of liquid exiting the liquid nozzle opening.

10. An integrated air cap/nozzle according to claim 1, wherein the nozzle body comprises one or more frusto-conically shaped sections, one or more cylindrically shaped sections or a combination thereof.

11. A liquid spray gun comprising:

a nozzle port;

a removable integrated air cap/nozzle comprising a nozzle body, the integrated air cap/nozzle removably attached to the liquid spray gun, wherein the nozzle body of the integrated air cap/nozzle is positioned over the nozzle port when the integrated air cap/nozzle is attached to the liquid spray gun; and wherein the integrated air cap/nozzle comprises a nozzle aperture, a nozzle outlet end located within the nozzle aperture, and a liquid nozzle opening located within the nozzle outlet end through which liquid exits during operation of the liquid spray gun and a center air outlet located in a gap defined between the nozzle aperture and the nozzle outlet end, through which center air discharges when a liquid is sprayed through the integrated air cap/nozzle;

wherein the liquid nozzle opening and the center air outlet are formed in the removable integrated air cap/nozzle.

12. A liquid spray gun according to claim 11, wherein the integrated air cap/nozzle further comprises a liquid port in fluid communication with the nozzle body.

13. An integrated air cap/nozzles according to claim 1 wherein the front wall comprises at least one pair of auxiliary air apertures.

14. A liquid spray gun according to claim 11 wherein the integrated air cap/nozzle comprises at least one pair of auxiliary air apertures.

* * * * *